US005683024A

United States Patent [19]

Eminger et al.

[11] Patent Number: 5,683,024

[45] Date of Patent: Nov. 4, 1997

[54] FASTENER DRIVING DEVICE PARTICULARLY SUITED FOR USE AS A ROOFING NAILER

[75] Inventors: Mark R. Eminger, Warwick; Leo E. LaBarre, West Warwick, both of R.I.; Daniel A. Oliver, Cincinnati, Ohio

[73] Assignee: Stanley-Bostitch, Inc., East Greenwich, R.I.

[21] Appl. No.: 463,631

[22] Filed: Jun. 6, 1995

Related U.S. Application Data

[63] Continuation of Ser. No. 60,946, May 13, 1993, abandoned.

[51] Int. Cl.[6] ..... B25C 7/00

[52] U.S. Cl. ..... 227/8; 227/113; 227/128; 227/136; 227/137

[58] Field of Search ..... 227/135, 137, 227/136, 8, 128, 113

[56] References Cited

U.S. PATENT DOCUMENTS

| | | | |
|---|---|---|---|
| 2,714,208 | 8/1955 | Jenny | 227/128 |
| 2,927,324 | 3/1960 | Ollig et al. . | |
| 3,491,932 | 1/1970 | Novak . | |
| 3,703,981 | 11/1972 | Smith . | |
| 3,708,096 | 1/1973 | Burke, Jr. . | |
| 3,708,097 | 1/1973 | Fisher . | |
| 3,945,551 | 3/1976 | Sato et al. . | |
| 4,375,867 | 3/1983 | Novak et al. . | |
| 4,389,012 | 6/1983 | Grikis et al. | 227/113 X |
| 4,433,782 | 2/1984 | Figge et al. . | |
| 4,597,517 | 7/1986 | Wagdy | 227/8 |
| 4,597,518 | 7/1986 | Paul | 227/128 |
| 4,600,135 | 7/1986 | Mukoyama | 227/120 |
| 4,858,812 | 8/1989 | Fealey . | |
| 4,942,996 | 7/1990 | Wolfberg et al. | 227/128 X |
| 4,981,247 | 1/1991 | Noll | 227/156 |
| 5,025,970 | 6/1991 | Anderson et al. | 227/156 |
| 5,083,694 | 1/1992 | Lemos | 227/8 |
| 5,085,126 | 2/1992 | Mukoyama . | |
| 5,192,012 | 3/1993 | Schafer et al. | 227/113 |
| 5,366,132 | 11/1994 | Simonelli | 227/8 |

FOREIGN PATENT DOCUMENTS

| | | |
|---|---|---|
| 0008749 | 3/1980 | European Pat. Off. . |
| 0169172 | 1/1986 | European Pat. Off. . |
| 3224089 | 12/1983 | Germany . |
| 9106241.1 | 10/1991 | Germany . |
| 1206948 | 9/1970 | United Kingdom . |
| 2151176 | 1/1985 | United Kingdom . |

*Primary Examiner*—Rinaldi I. Rada
*Assistant Examiner*—Boyer Ashley
*Attorney, Agent, or Firm*—Cushman Darby & Cushman Intellectual Property Group of Pillsbury Madison & Sutro LLP

[57] ABSTRACT

A housing including a handle portion and drive portion is provided. A power operated drive in the housing drive portion is operable to be selectively moved through a drive stroke and a return stroke. A nosepiece and magazine assembly are carried by the housing including cooperating fixed and movable structure defining an elongated drive track, a feed track leading laterally into the drive track, and a coil container leading into the feed track. A fastener driving element is slidably mounted in the drive track and operatively connected with the power operated drive so as to drive a leading fastener fed into the drive track from the feed track outwardly of the drive track. The unitary movable structure is mounted for pivotal movement when a fastener package has been depleted from a closed operating position in cooperating relation with the fixed structure into an open loading position. An actuating mechanism is provided for actuating the power operated drive to move through an operating cycle. An actuation prevention mechanism is provided for preventing the actuation of the power operated drive by the actuating mechanism in response to the movement of the movable structure from the closed operating position to the open loading position. A resilient guard structure is disposed on the housing and extends outwardly from the periphery thereof. Mechanical structure is provided for fixedly mounting the resilient guard structure on the housing.

41 Claims, 8 Drawing Sheets

246
16
232
44
12
10
244
242
234
230
194
322
22
329
190
306
302
318
58
308
300
118
54
48
196
32
30
312
314
310
316
14
14A
24
112
116
88

FASTENER DRIVING DEVICE PARTICULARLY SUITED FOR USE AS A ROOFING NAILER

This is a continuation of application Ser. No. 08/060,946, filed on May 13, 1993, now abandoned.

This invention relates to fastener driving devices and, more particularly, to portable power-actuated fastener driving devices.

A common type of fastener package used in conjunction with portable power-actuated fastener driving devices is the coil fastener package. This fastener package is made up of a series of headed nails in a spaced parallel array interconnected by an elongated flexible carrier. Carriers come in several different forms. A well known one being a pair of parallel wires welded to the shanks of each nail in the array so as to maintain them in substantially parallel relation. With this arrangement, the portion of the wires which extend between each pair of adjacent parallel nails acts in effect like a parallel linkage.

The utilization of nails of this type is highly desirable because larger numbers of nails are frequently packaged in coil formation. Fastener driving devices utilizing coiled nail packages typically include a feeding mechanism, a cylindrical container into which a new coiled nail package is placed, and a feed track therebetween. The feeding mechanism for coiled nail packages of the type described have heretofore been of the rachet type an example of which is disclosed in commonly assigned U.S. Pat. No. 4,858,812 to Fealey. Because of the nature in which the successive nails are interconnected, it is important that the leading portion of the nail package be properly positioned within the drive track and engaged with the rachet feed mechanism. To assure proper positioning of the nails, operator access to the drive track, feed mechanism, feed track and coil container must be provided.

Access is usually provided to each of the above mentioned members by multiple doors which permit the operator to load a new coiled nail package into the device. An advantage of multiple door construction is that each of the doors is relatively small, light, and close to its axis of rotation. This arrangement permits the device to be conveniently handled by the operator when reloading. However, problems are encountered with this type of arrangement. This arrangement requires the operator to typically use both hands to load the fastener package into the device. Thus, the device is generally placed down to enable the operator to load the device. Time is wasted in opening each door and in placing down the device. Further, the fabrication and assembly of multiple doors adds additional cost.

One proposal to provide single door access is disclosed in U.S. Pat. No. 4,600,135. The arrangement disclosed includes a single door that is pivotally movable about a vertical axis near the drive track. This arrangement has the advantage of permitting quick access for loading the device. However, this construction has a major drawback. Because of the large door size and the distance that the door extends horizontally from its vertical axis, the device becomes unbalanced when the door is fully opened making the device clumsy for an operator in use. Moreover, because of the distance that the door extends when pivoted from its vertical axis, enough room must be provided for the door to be fully opened.

An object of the present invention is to provide single door access for a fastener driving device which obtains all of the advantages of the multiple and single door devices described above without the disadvantages of either. In accordance with the principles of the present invention, this objective is accomplished by providing a fastener driving device including a housing having a handle portion enabling a user to manually operate the device in portable fashion and a drive portion disposed forwardly of the handle portion. Power operated means are provided in the housing drive portion operable to be selectively moved through successive operating cycles each of which includes a drive stroke and a return stroke. A nosepiece and magazine assembly are carried by the housing including cooperating fixed and movable structure defining an elongated drive track, a feed track leading laterally into the drive track, and a coil container leading into the feed track. A fastener driving element is slidably mounted in the drive track and operatively connected with the drive means so as to drive a leading fastener fed into the drive track from the feed track outwardly of the drive track and into a workpiece during the drive stroke of the drive means. The nosepiece and magazine assembly include a unitary movable structure defining a side portion of the drive track, a side portion of the feed track and a side and top portion of the container. Means are provided for mounting the unitary movable structure for pivotal movement when a fastener package has been depleted from a closed operating position in cooperating relation with the fixed structure into an open loading position wherein (1) the drive track is accessible along the side portion defined by the movable structure so as to enable a leading fastener of a new fastener package to be positioned therein, (2) the feed track is accessible along the side portion defined by the movable structure so as to enable a leading portion of the array of the new fastener package to be positioned therein, and (3) the container is accessible along the side and top portions defined by the movable structure so as to enable the coil formation of the new fastener package to be positioned therein, and from the open loading position after a new package has been positioned as aforesaid into the closed operative position. A releasable latch is mounted for manual movement from an operative position retaining the movable structure in the closed operative position into a releasing position. The position of the pivotal axis of the unitary movable structure is such that when the device is held by the handle portion in a position such that a fastener would be moved out of the drive track in a substantial downward direction the movable structure will be moved by gravity from the closed operative position into the open loading position in response to the manual movement of the latch into the releasing position.

It is highly desirable to be able to load the device with one hand while it is being held by the other, particularly, when the operator is using the device to fasten roof shingles to a roof surface. However, the roof environment is such that normal precautions in handling the device may be compromised somewhat. Consequently, where a device is to be particularly suited to on-roof use, it is further desirable to provide additional safeguards.

Accordingly, another object of the invention is to provide a fastener driving device of the type described which provides such safeguards. In accordance with the principles of the present invention, this objective is obtained by providing an actuating mechanism for actuating the power operated drive means to move through an operating cycle. An actuation prevention mechanism is provided for preventing the actuation of the power operated means by the actuating mechanism in response to the movement of the movable structure from the closed operating position to the open loading position.

A further problem is encountered with fastener driving devices of the type heretofore described when the device is used as a roofing nailer. Pitched roofs having inclined surfaces present the possibility of the device sliding off the roof due to gravity when the device is placed down on the roof because the device is not presently being used. Devices having exterior surfaces made of metal compound the problem by providing little frictional resistance which would prevent the device from sliding. Moreover, the sliding causes wear of the exterior surface of the housing. Thus, there is a need for a fastener driving device which is prevented from sliding when placed down on an inclined roof surface and which provides a wear surface.

One proposal to provide a wear and impact surface is disclosed in U.S. Pat. No. 5,085,126. The construction disclosed includes a rubber strip extending on both sides and across the cap of the housing and attached in surface engagement by an adhesive. This mode of securement results in either insufficient adherence or difficulties when it is desired to replace the rubber strip.

Accordingly, another object of the present invention is to provide a fastener driving device of the type described which obviates the problems of location of the rubber strip and does not become loose in use in the manner set forth above. In accordance with the principles of the present invention, this objective is achieved by providing a resilient guard structure on opposite sides of the periphery of a main drive portion of the housing and extending outwardly therefrom. The resilient guard structure has outwardly facing surfaces disposed outwardly of the opposite sides of the periphery of the housing main drive portion. The device when not being used in portable fashion is capable of being selectively supported in either of two support positions on a support surface in which one side of the periphery of the housing main drive portion faces toward the support surface with an area of corresponding outwardly facing surface of the resilient guard structure in engagement with the support surface. Mechanical structure is provided for fixedly mounting the resilient guard structure on the main drive portion of the housing. The mechanical structure includes J-shaped hooks embedded in opposite ends of the resilient guard structure and extending outwardly thereof and bolts entering the J-shaped hooks. The bolts also serve to detachably fixedly mount a cap on an open upper end of a drive portion of the housing disposed forwardly of the handle portion thereof.

While the resilient guard structure is shown in conjunction with a fastener driving device utilizing coiled nail packages, in its broadest aspects the present invention contemplates the utilization of this feature with any type of fastener driving device.

A further problem is presented with fastener driving devices using fasteners of the type interconnected in an array by a pair of parallel wires attached to the shanks of each nail. In the ratchet mechanism heretofore described, it is the usual situation for the ratchet mechanism to feed off of the nail shank which is adjacent to the leading nail as shown in commonly assigned U.S. Pat. Nos. 3,708,097 and 3,703,981. Typically, the leading nail which is disposed in the drive track is supported in the drive track by the wires which extend from the adjacent shank. This arrangement has the advantage of not having members protrude into the drive track. However, this arrangement does not provide support for the last nail. In devices which are capable of feeding the last nail into the drive track, the unsupported last nail can fall out of the drive track. In other devices, the last nail remains partially in the feed track which in the unsupported condition is prone to creating inadvertent jamming of the last nail when the operator attempts to drive the last nail from the device. One solution will known in the art is to prevent the actuation of the device when only a few fasteners remain in the feedtrack. This arrangement has the disadvantage of not utilizing all of the fasteners in the magazine.

One type of nail feeding mechanism capable of feeding and supporting the last nail in the drive track is well known in the art. This type of mechanism embodies a nail feeding pawl provided with a surface for engaging the trailing shank surfaces of the leading nail in the nail feeding track. At the end of the nail feeding stroke of such a nail feeding pawl, the shank engaging surface thereof is disposed within the drive track at a position beneath the trailing portion of the circular head of the nail therein. Because of this relationship of the nail feeding pawl within the drive track, it is essential to provide for a rapid return stroke of the nail feeding pawl to prevent interengagement of the nail head therewith during the driving movement of the latter. Where air pressure is utilized as the means for effecting the return stroke of the nail feeding pawl, the rapidity at which the return stroke can be initiated tends to vary in accordance with source pressure. Thus, where lower source pressures are utilized or occur interferences tend to take place.

Accordingly, another object of the present invention is to provide a fastener driving device of the type described in which the last nail can be driven from the drive track without having support members protruding into the drive track. In accordance with the principles of the present invention, this objective is achieved by providing pneumatic drive means which include a cylindrical drive chamber and a piston mounted within the drive chamber and operatively connected with the fastener driving element for movement through a drive stroke and a return stroke. A return air plenum chamber is provided for effecting the fastener driving element return stroke. Nail feeding means are mounted for movement only within the feed track so as to successively move the leading nails of the array into the drive track at the end of the return stroke. Last nail holding means are provided for retaining the last nail of the array within the drive track such that the last nail of the array is driven outwardly of the drive track and into a workpiece during the drive stroke of the fastener driving element. The last nail holding means includes a magnet mounted to said nosepiece and extending to the periphery of the drive track for receiving and holding the head of the last nail thrust into said drive track by said nail feeding means. Means are provided for dissipating the air under pressure within the plenum chamber which effects the return stroke of the piston which is exhausted through the drive track to the atmosphere at the end of the return stroke of the piston so that the last nail being held by the magnet is not blown off of the magnet by air exhausting the plenum chamber.

Another object of the present invention is the provision of single door which provides access to the drive track, feed track and coil container in a fastener driving device utilizing coiled nail packages which is simple in construction, effective in operation and economical to manufacture.

These and other objects of the present invention will become more apparent during the course of the following detailed description and appended claims.

The invention may best be understood with reference to the accompanying drawings wherein an illustrative embodiment is shown.

Figures 1, 6, 7, 8:
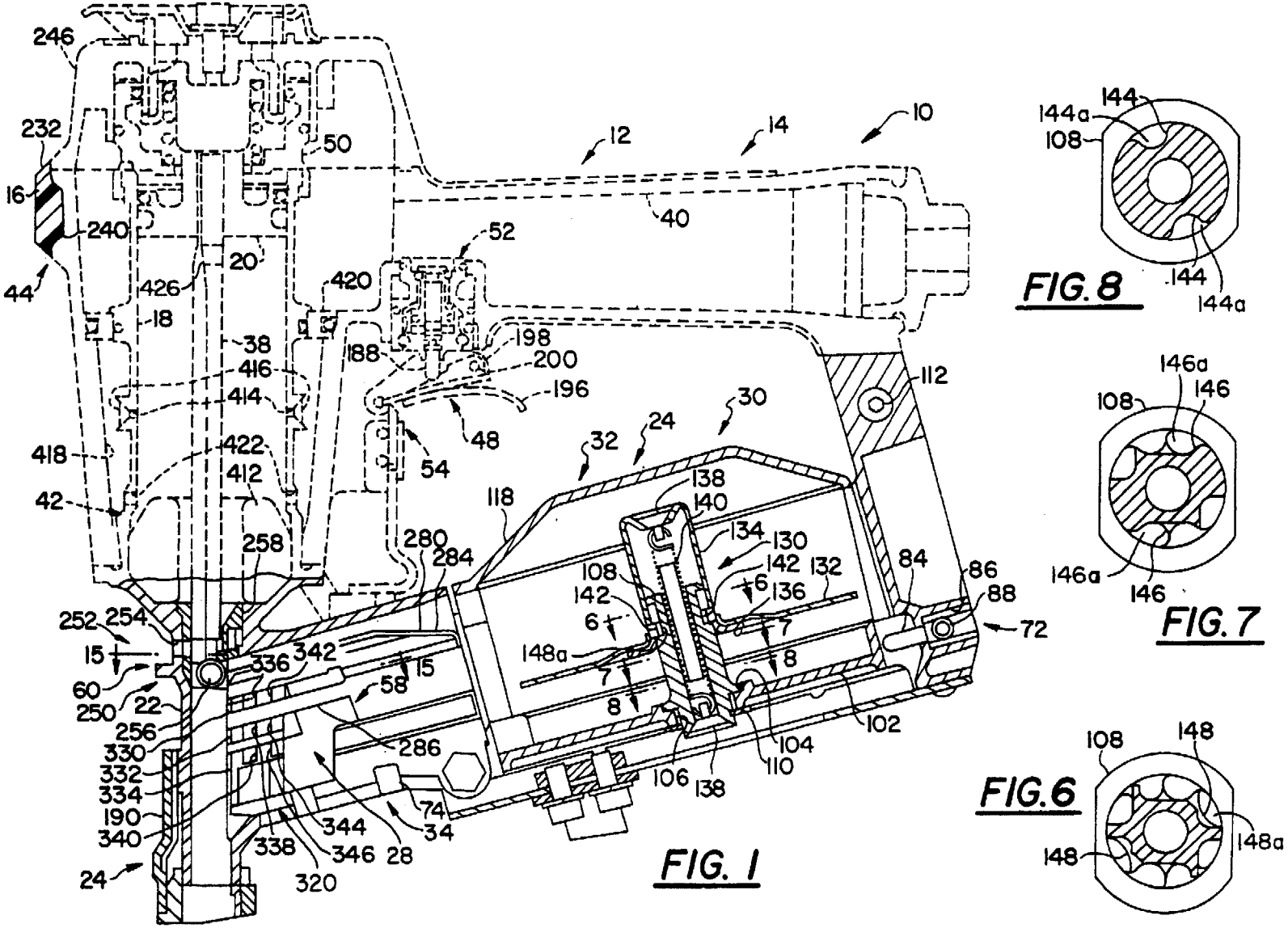
FIG. 1 is a side elevational plan view of a fastener driving device constructed in accordance with the present invention shown partly in section for clarity, with the unitary movable structure shown in the closed operative position, with the housing and power operated means shown in dotted lines.
FIG. 6 is a cross-sectional view of the spindle taken along line 6—6 of FIG. 1.
FIG. 7 is a cross-sectional view of the spindle taken along line 7—7 of FIG. 1.
FIG. 8 is a cross-sectional view of the spindle taken along line 8—8 of FIG. 1.
Figure 17:
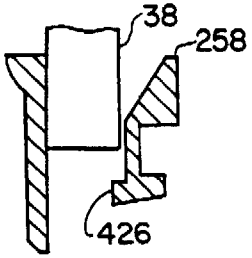
Figure 4:
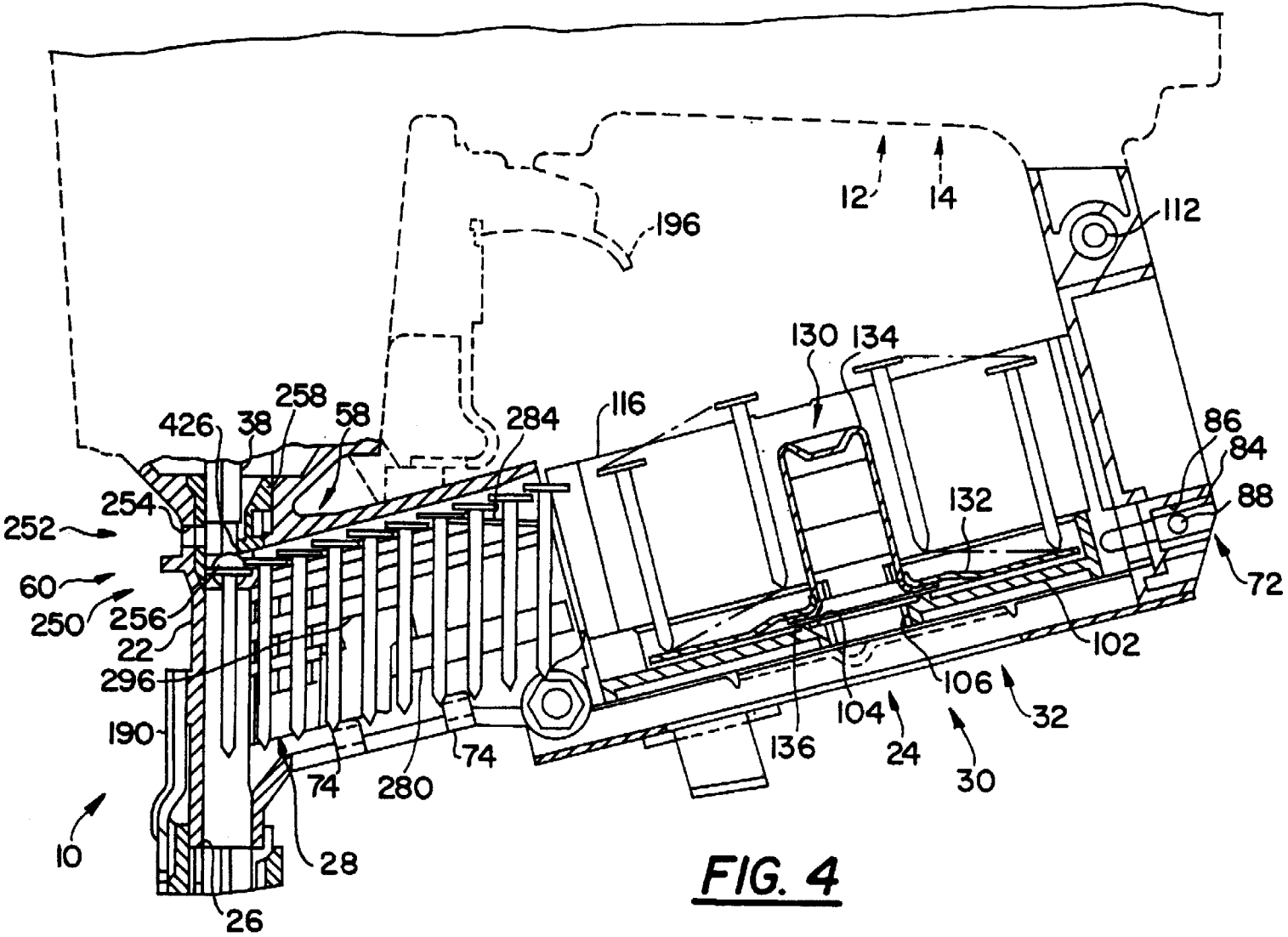
FIG. 4 is a side elevational plan view shown partly in section, with a fastener package loaded therein with the unitary movable structure omitted for clarity.
Figures 14, 14A:
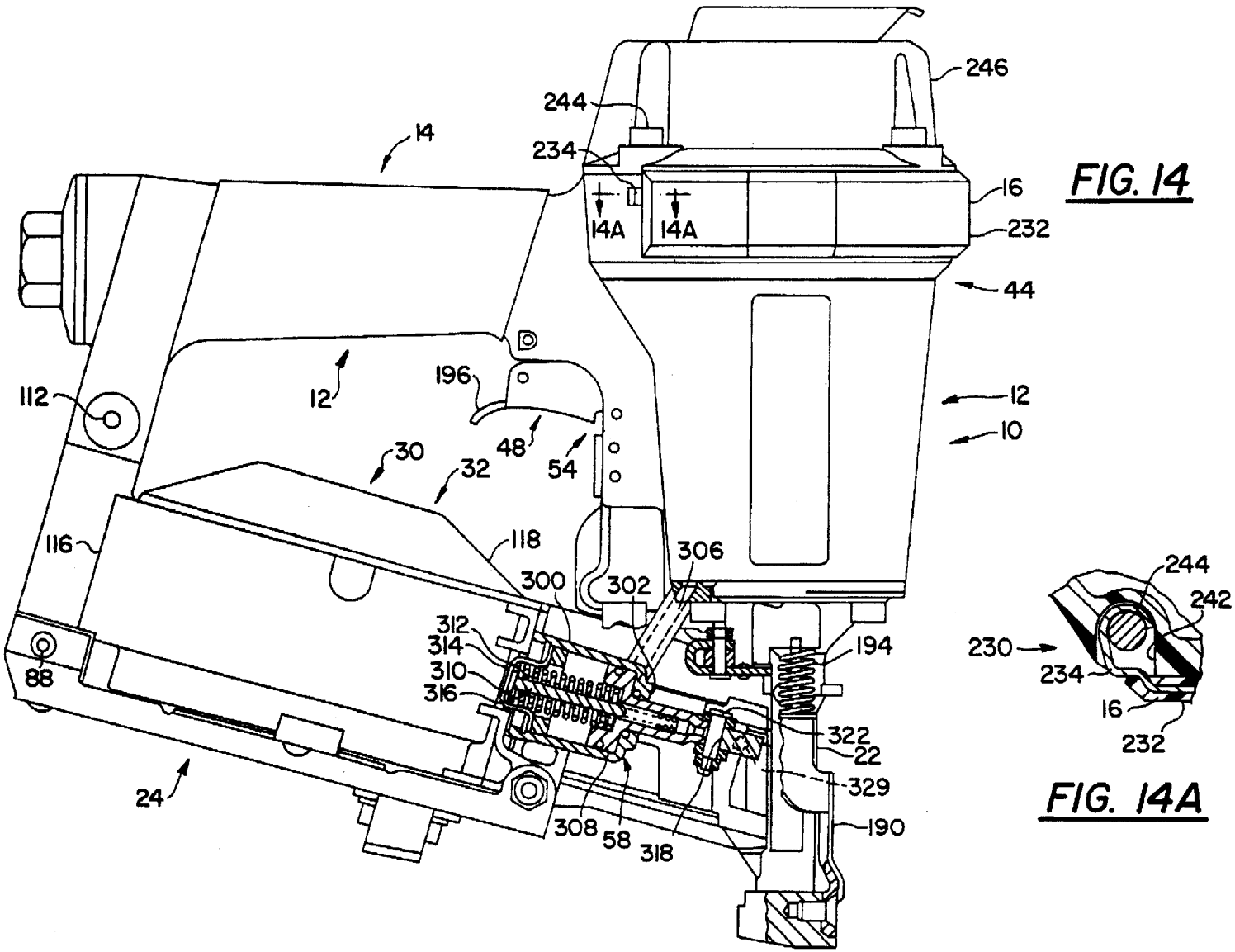
FIG. 14 is a side elevational view showing the side opposite FIG. 1, shown partly in section for clarity.
Figure 15:
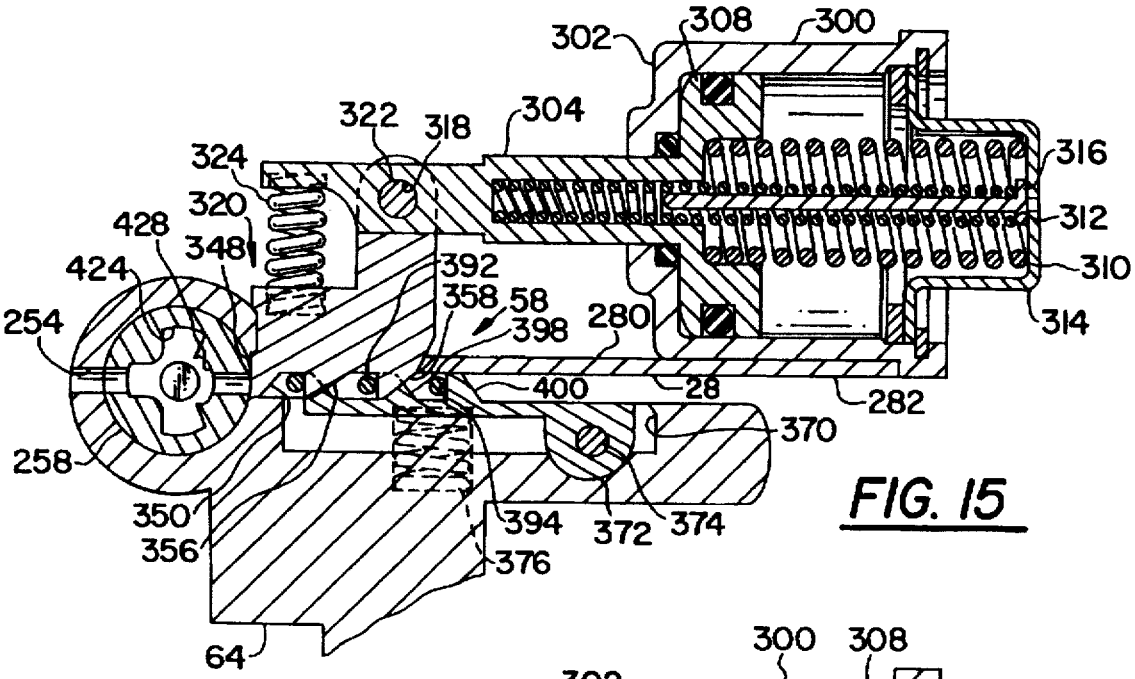
Figure 16:
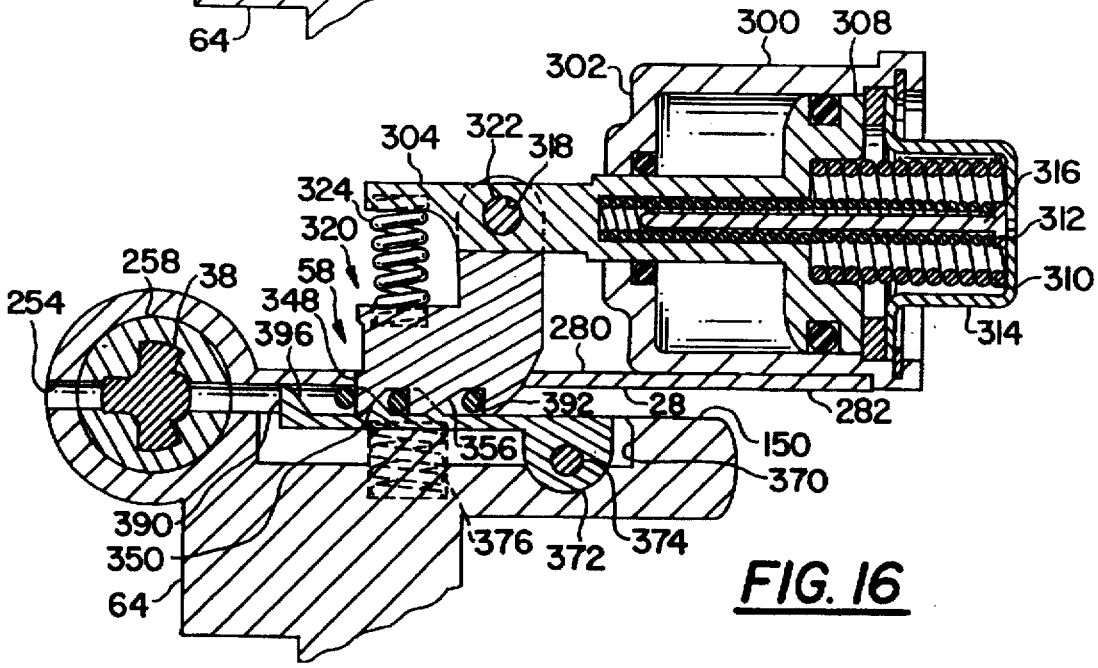

FIG. 14*a* is a cross-sectional view of the J-shaped hook of the resilient guard member and bolt taken along line 14*a*—14*a* of FIG. 14;

FIG. 15 is a top sectional view taken along line 15—15 of FIG. 1 showing the actuating rod in its extended position;

FIG. 16 is a top sectional view similar to FIG. 15 showing the actuating rod in its retracted position; and FIG. 17 is an enlarged side view, shown partly in section, showing the clearance between the fastener driving element and fastener driving element guide at the end of the return stroke of the fastener driving element.

Referring now more particularly to FIG. 1 of the drawings, there is shown therein a portable pneumatically operated fastener driving device in the form of a portable tool, generally indicated at 10, which is constructed in accordance with the principles of the present invention. In the drawings, the device is shown oriented so as to drive a fastener vertically downwardly into a workpiece. It will be understood, however, that the device is capable of driving a fastener into workpieces oriented in any position other than the horizontal. For convenience, the device will be described in relation to the orientation illustrated, and consequently terms such as "horizontal," "vertical," "above," "below," "forward," "rearward," etc. as used herein are to be construed in their relative sense.

As shown, the device 10 includes a portable rigid housing assembly, generally indicated at 12, which provides a handle portion 14. Attached to the periphery of the housing is a resilient guard structure, generally indicated at 16, embodying the principles of the present invention. In accordance with conventional practice, a drive chamber in the form of a cylinder 18 is mounted within the housing assembly 12, within which is slidably mounted a driving piston 20. Except when specifically required, although pneumatic systems are generally preferred, other systems either power or manually operable can be used, for effecting the cycle of operation of the fastener driving element may be utilized as, for example, electrical systems, spring actuated systems, hammer actuated systems, internal combustion systems and the like.

Figure 5:
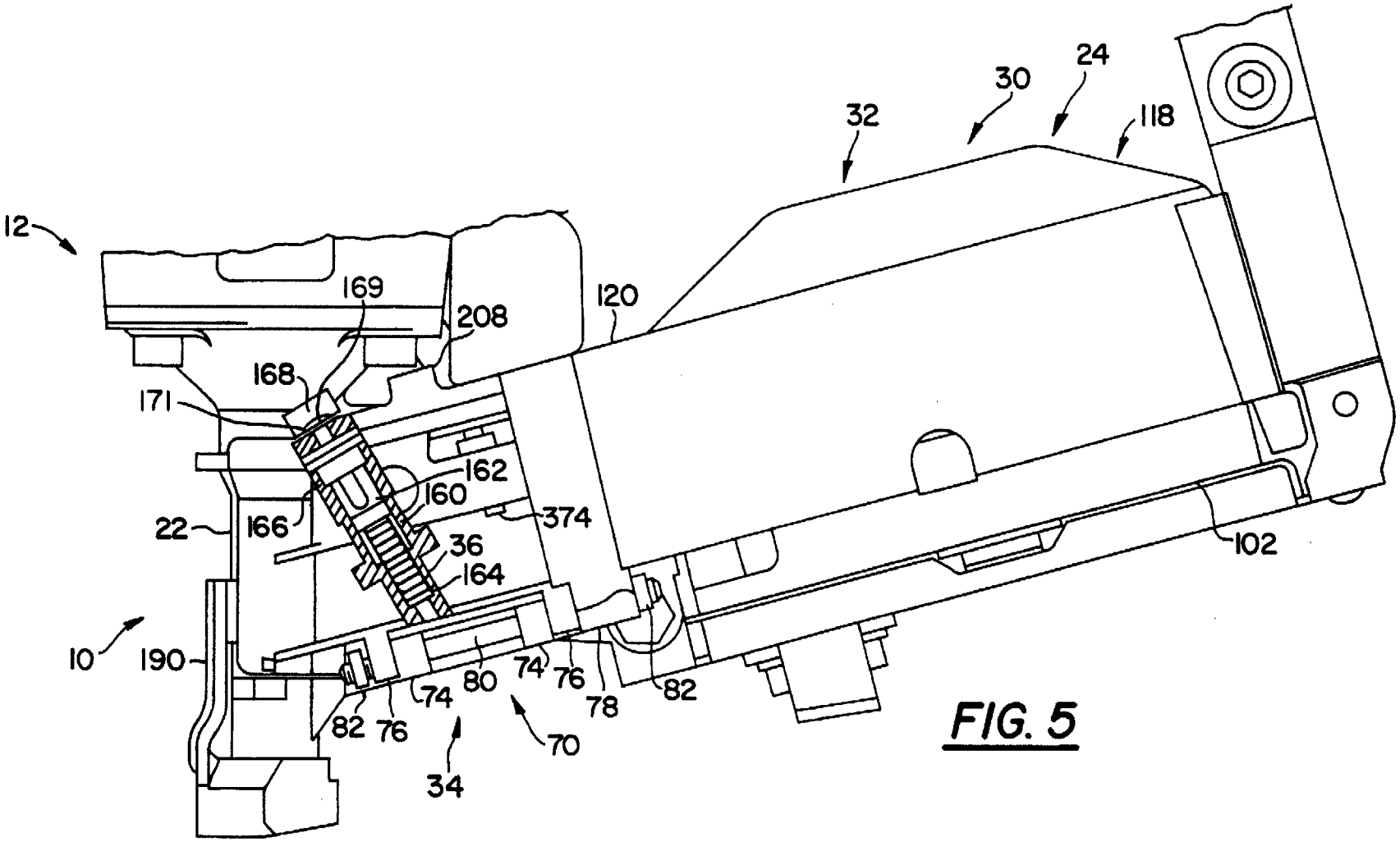
FIG. 5 is a side elevational plan view shown partly in section, with the unitary movable structure shown in the closed operative position.

A nosepiece 22 and magazine assembly, generally indicated at 24, are both carried by the housing assembly 12 and together define therewith, a drive track, generally indicated at 26, a feed track, generally indicated at 28 and a coil container, generally indicated at 30. The nosepiece 22 and magazine assembly 24 include a unitary movable structure, generally indicated at 32 which is in cooperating relation with the housing assembly 12. Means for mounting the unitary movable structure for pivotal movement is generally indicated at 34. A releasable latch 36 FIG. 5 is mounted on the unitary movable structure 32 so as to secure the unitary movable structure 32 into cooperating relation with housing assembly 12.

A fastener driving element 38 is fixed to the driving piston 20 and extends within the drive track 26. Means is provided within the housing 12 to effect the return stroke of the piston 20. For example, such means may be in the form of a conventional plenum chamber return system 42 such as disclosed in U.S. Pat. No. 3,708,096, the disclosure of which is hereby incorporated by reference into the present specification. In accordance with conventional practice, the handle portion 14 contains a reservoir 40 for receiving a source of air under pressure which is communicated with the upper end of the cylinder 18 by a pilot pressure operated main valve assembly 50, within the main drive portion, generally indicated at 44, which is under the control of a trigger valve assembly 52 operated by a contact trip and trigger assembly 54, which together comprise part of the actuating mechanism 48, which function in accordance with conventional procedures although the actuation means may be of any known construction. An actuation prevention mechanism for preventing the actuation of the device operates in response to the unitary movable structure being moved from the closed operative position to the open loading position embodying the principles of the present invention and is generally indicated at 56. Nail feeding means in the form of a ratchet type fastener feeding mechanism, generally indicated at 58, is operable to cooperate with a leading end portion of a coiled fastener package array contained within coil container 30. Last nail holding means for retaining the last nail of the array within the drive track 26 is generally indicated at 60 embodying the principles of the present invention.

Likewise, the coiled fastener packages utilized with the tool may be of any known construction. The fastener package is preferably made up of a series of headed nails interconnected in an array by a pair of parallel wires welded to the shanks of each nail in the array so as to maintain them in substantially parallel relation. The wires are welded in angular relation (75°) across the parallel nail shanks. The array of nails is then wound into a spiraled coil formation in which the heads of convolutes are disposed in overlapped relation with respect to the heads of the preceding convolutes. It will be understood that the present invention contemplates selecting any one of a series of different nail sized coils.

Figure 3:
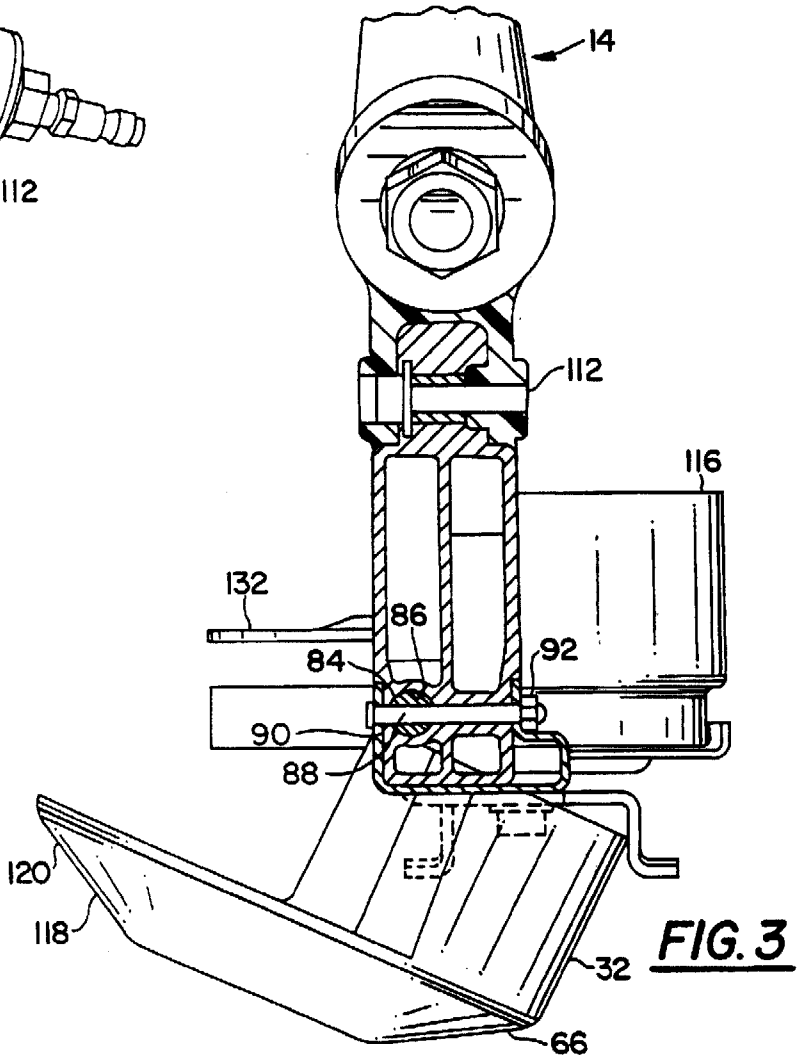
FIG. 3 is a rear elevational plan view, shown partly in section, with the unitary movable structure shown in the open loading position.

As described above and shown in FIG. 2, unitary movable structure 32 together with housing assembly 12 forms drive track 26, feed track 28, and coil container 30. Unitary movable structure 32 includes a feed track door portion 64 and a coil container portion 66 which are interlocked to one another which provides a rigid connection when mounted on the hinge assemblies as described below. Unitary movable structure 32 is carried by the housing assembly 12 by a forwardly mounted first hinge assembly, generally indicated at 70, and rearwardly mounted second hinge assembly, generally indicated at 72. As shown in FIG. 5, first hinge assembly includes a first pair of coaxial apertured lugs 74 attached to the housing assembly 12 and disposed below the feed track 28. A second pair of coaxial apertured lugs 76 are attached to the unitary movable structure 32 and forwardly and rearwardly positioned from the first pair of apertured lugs 74, respectively so as to cooperate therewith. Positioned rearwardly from both pairs of apertured lugs 74, 76 is an apertured lug 78 attached to the coil container portion 66 of the unitary movable structure 32 and aligned with lugs 74 and 76. Extending through apertured lugs 74, 76 and 78 is a door pin 80 which is retained by plastic collars 82 or the like defining a pivot axis of the hinge 70. Second hinge assembly 72 includes a pivot pin 84 which extends through holes 86 formed in the upwardly extending peripheral wall portion 116 and base member 102 and retained therein by cross pin 88. As shown in FIG. 3, cross pin 88 has a shoulder portion 90 and is retained by plastic collar 92 or the like. Thus, the unitary moveable structure 32 may pivot about pins 80 and 84 to a position shown in FIG. 3.

Figure 2:
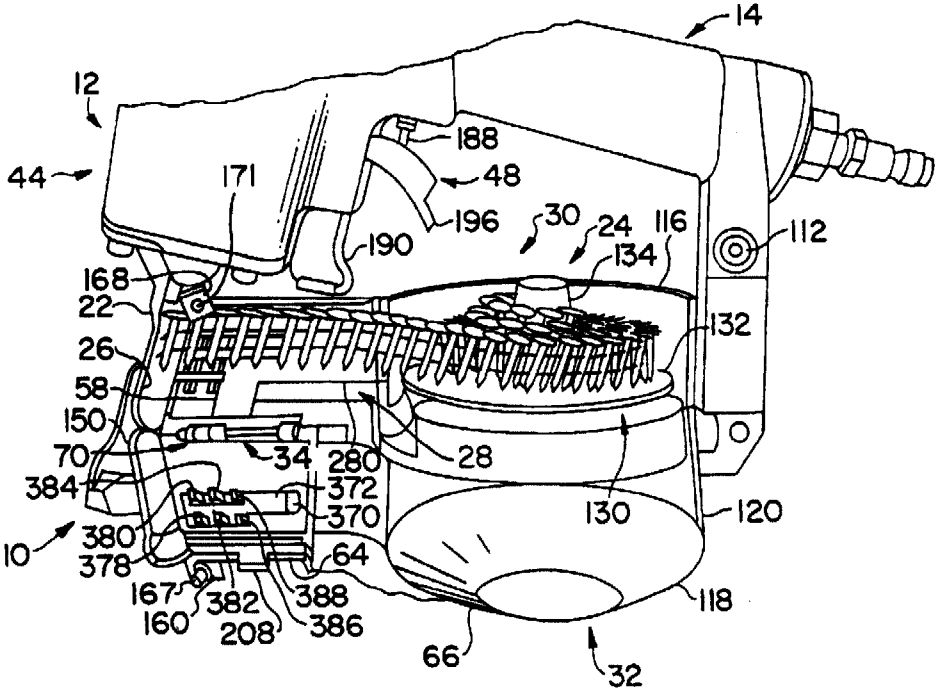
FIG. 2 is a side elevational perspective view of the device of FIG. 1. with a fastener package loaded therein with the unitary movable structure shown in the open loading position.

Referring now more particularly to FIGS. 1–3, the magazine assembly 24 includes the coil container 30. The coil container 30 includes a base member 102 of generally disc-shaped configuration having an inner peripheral flange 104 and a central aperture 106 formed therein for receiving one end of a hollow spindle 108 secured to the central portion of the base member, by any suitable means, such as a retaining ring 110. Base member 102 is fixedly secured to the housing assembly 12 by any suitable means such as bolts 112. Base member 102 has an upwardly extending peripheral wall portion 116 having a semi-circular cross section which forms one half of the cylindrical portion of the coil container 30. The coil container portion 66 of unitary movable structure 32 forms the remaining cylindrical wall portion 118 of the coil container 30 as best shown in FIG. 2 and also provides the cover 120 when moved into the closed operative position and thus provides peripheral confinement for the fastener package when the unitary movable structure is moved into the closed operative position. It should be noted that the coil container 30 has a forwardly located vertical opening which opens into the feed track 28 so as to allow fasteners to be moved from the coil container into the feed track.

Carried by the fixed spindle 108 for movement into a plurality of adjusted positions with respect thereto, is a fastener package supporting assembly, generally indicated at 130. The assembly 130 includes a movable disc-shaped fastener support member 132 which is attached to post member 134 by any suitable means such as welding. Post member 134 is cylindrical in configuration and has a radially outwardly extending flange portion 136 for supporting support member 132.

Secured to one end of the fixed spindle 108 and an opposite end of the post member 134 are spring receivers 138. Extending through spindle 108 and post member 134 is an extension spring 140 which is attached at opposite ends to the spring receivers and serves to resiliently bias the supporting assembly in a direction toward base member 102.

Height adjustment of support member is provided for maintaining the support assembly 130 in different spaced positions from the base member 102 for the purpose of accommodating fastener packages of various sizes. As best shown in FIG. 1, such adjustment means comprises a plurality of vertically and angularly spaced pairs of slotted shoulders on spindle 108 and a pair of tabs 142 fixedly secured to post member 134 and to be brought into vertical and rotational engagement with the spaced pairs of slotted shoulders 144, 146 and 148, respectively each defining a respective seating surface **144*a*, 146*a* and 148*a*. When the support assembly 130 is adjusted to accommodate a small size fastener package, each of the tabs 142 extends into a slot as shown in FIGS. 1 and 6 and rests against an associated seating surface. When it is desired to accommodate a fastener package of a larger size, the operator grasps the movable post member 134 and pulls the same until post member 134** is brought out of engagement with that shoulder and is then rotated so as to engage a different slot and associated seating surface thereof and effect a different height adjustment.

Unitary movable structure also includes a drive track door portion 64 which extends in the direction of extent of the drive track 26 and forms a portion thereof. Drive track door portion 64 has a vertically extending segmental portion 150 in a forward portion thereof which forms a portion of the drive track 26.

Mounted on drive track door portion 64 is a releasable latch 36 which is mounted for manual movement from an operative position retaining the unitary movable structure 32 in a closed operative position into a releasing position. Releasable latch 36 includes a latch body 160 and a slidable locking member 162 mounted for sliding movement therein with respect to the latch body which is normally biased into a latching position by a spring 164. Spring 164 is seated at one end thereof against seat 163 of the latch body 160, with the other end thereof in contact with the locking member 162. A catch 168 having a bore 171 of the housing assembly 12 receives end 169 of the locking member 162 in bore 171 so as to retain unitary movable structure 32 in the closed operative position when the former is in the latching position. A finger engaging tab 166 extends outwardly from the locking member 162 enabling an operator to manually move locking member 162 against the bias of spring 164 and out of engagement with catch 168 into a releasing position.

It can thus be seen that since the unitary movable structure 32 is mounted for pivotal movement when a fastener package has been depleted from a closed operating position in cooperating relation with the fixed structure into an open loading position wherein (1) the drive track is accessible along the side portion defined by the movable structure so as to enable a leading fastener of a new fastener package to be positioned therein, (2) the feed track is accessible along the side portion defined by the movable structure so as to enable a leading portion of the array of the new fastener package to be positioned therein, and (3) the container is accessible along the side and top portions defined by the movable structure so as to enable the coil formation of the new fastener package to be positioned therein, and from the open loading position after a new package has been positioned as aforesaid into the closed operative position.

It should further be understood that the mass of the unitary movable structure 32 is laterally disposed from the hinge assemblies 70 and 72. In this manner the center of gravity thereof is located such that when the device is held by the handle portion 14 in a position such that a fastener would be moved out the drive track 26 in a substantial downward direction the unitary movable structure 32 will be moved by gravity into the open loading position from the closed operative position in response to the manual movement of the latch 36 into the releasing position.

Figure 9:
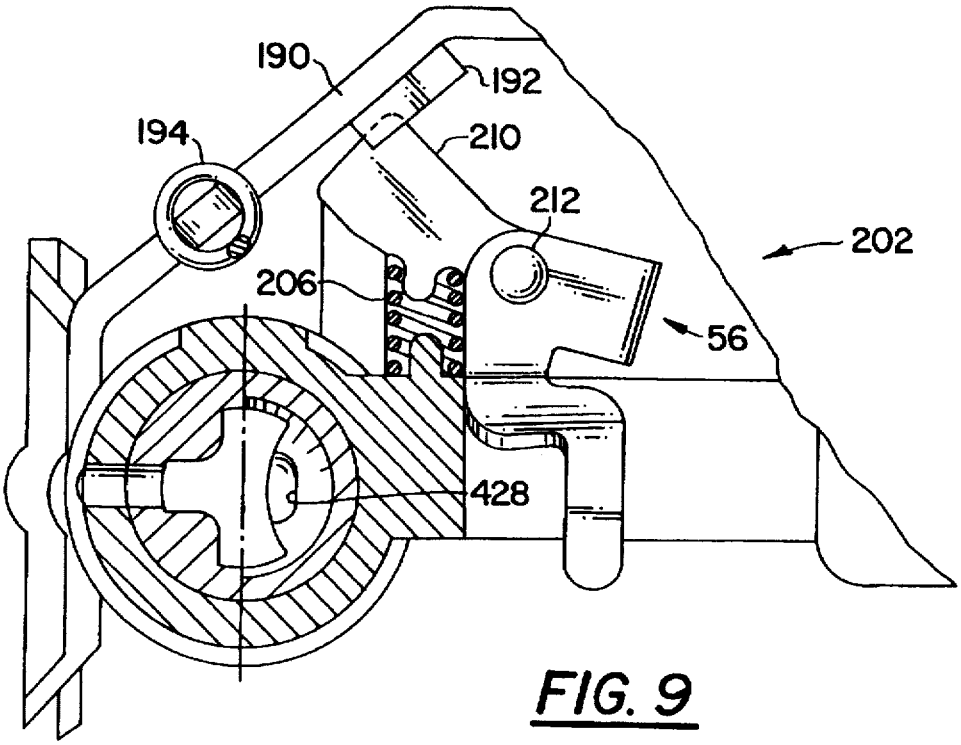
FIG. 9 is an enlarged top plan view partially in section of the interlocking member with the unitary movable structure shown in the open loading position and the interlocking member in the operative position.
Figure 10:
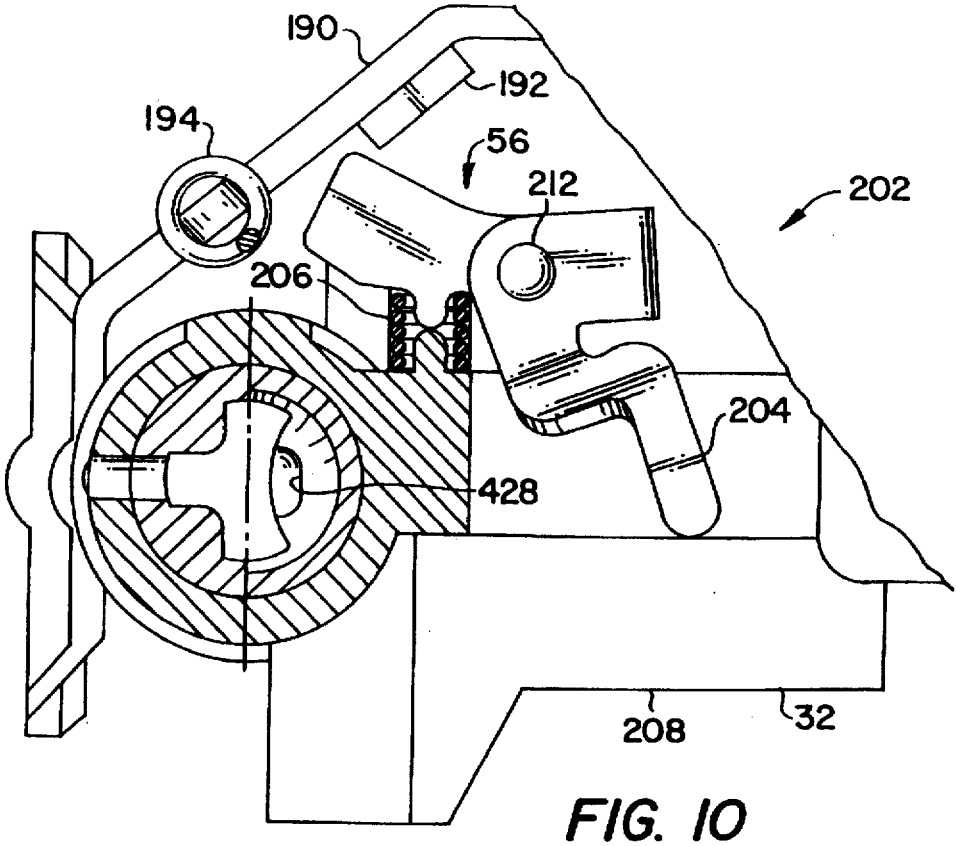
FIG. 10 is a view similar to FIG. 9 with the unitary movable structure shown in the closed operative position and the interlocking member in the inoperative position.
Figure 11:
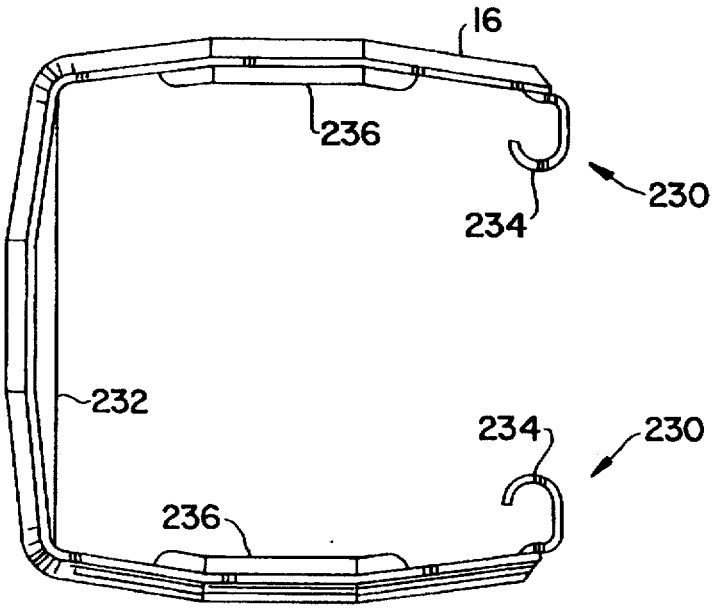
FIG. 11 is a top plan view of the resilient guard structure constructed in accordance with the present invention.
Figure 12:
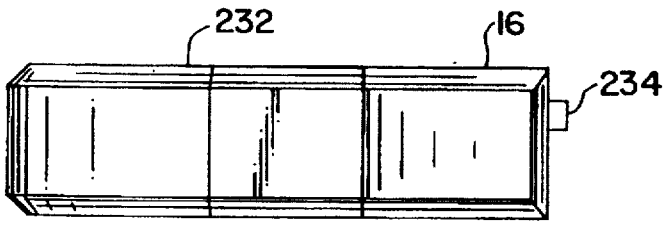
FIG. 12 is a side elevational view of the resilient guard structure of FIG. 11.
Figure 13:
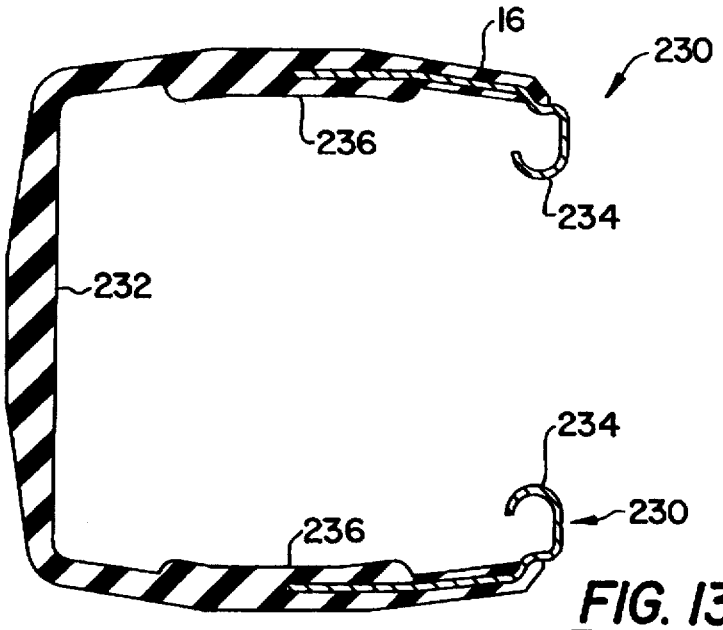
FIG. 13 is a top plan sectional view of the resilient guard structure.

Referring now more particularly to FIGS. 9–10, the device 10 includes an actuating prevention mechanism, generally indicated at 56, for preventing the actuation of the power operated means by the actuating mechanism 48, which operates in response to the movement of the movable structure 32 from the closed operating position to the open loading position. It should be understood that while the preferred embodiment is shown in conjunction with a fastener driving device utilizing coiled nail packages and a pneumatic fastener driving means, in its broadest aspects the present invention could be used with any type of fastener driving device. As previously mentioned, a trigger valve assembly 52 controls the actuation of the piston 20 through its fastener drive stroke. The trigger valve assembly includes a reciprocatively mounted depending actuating member 188 which controls the fluid pressure control system. Selective movement of the actuating member 188 from a normal outwardly extending inoperative position into an inwardly extending operative position initiates the driving piston 20 to move through a fastener driving stroke. The actuating mechanism 48 also includes a contact trip assembly 54 which includes a contact trip element 190 having a lower portion reciprocatively mounted in cooperating relationship with the nosepiece of the housing adjacent the drive track 26, an intermediate portion extending rearwardly therefrom and an upper vertically extending portion upon which a contact block 192 is mounted by any suitable means such as welding. For purposes of the present application, contract trip element 190 may be considered a work contact responsive member. The contact trip element 190 is resiliently urged into a downward inoperative position by a spring 194 so that the lower end portion thereof extends beyond the discharge end of the drive track 26. The work contact responsive member 190 is movable from its normal inoperative position in response to the movement of the device 10 into cooperative engagement with a workpiece. Movement of the device away from the workpiece serves to effect movement of the work contact responsive member 190 from its operative position back to its inoperative position under the action of the spring 194.

The actuating mechanism 48 also includes a conventional trigger member 196 which is pivotally mounted from the housing 12 and a trigger lever 198 pivotally mounted at 200 with the trigger member 196. The trigger lever 198 is adapted to depress actuating member 188 into its operative position for actuating the piston 20 and fastener driving element 38 as described heretofore. The trigger lever 198 is free to pivot at 200. Movement of the trigger member 196 alone into its operative position, without concomitant movement of work contact responsive member 190 into its operative position, will be ineffective to move actuating member 188 into its operative position, since the trigger lever 198 will not be in position to activate the actuating member 188. In accordance with conventional practice, upward movement of trigger lever 198 to contact actuating member 188 will fire the device when the work contact member 190 and the trigger member are moved together.

In accordance with the principles of the present invention, a means for preventing the power operated means to move through a fastener drive stroke is provided in the form of a contact trip interlocking mechanism, generally indicated at 202. An arrangement of the interlocking mechanism is illustrated in FIGS. 9–10. The interlocking mechanism is shown in the normal inoperative position in FIG. 10 and in the operative position in FIG. 9. Interlocking mechanism 202 includes the actuating prevention mechanism 56, which, in the illustrated embodiment is in the form of an interlocking member 204 which is pivotally mounted on pivot pin 212 on nosepiece 22 and biased into the operative position by spring 206. Interlocking member 204 is normally retained in the inoperative position when the unitary movable structure 32 is in the closed operative position by interlock engaging surface means in the form of a tab 208 which overcomes spring 206. Interlocking member 204 is moved into the operative position under the resilient bias of spring 206 when the unitary movable structure 32 is moved into the open loading position. When in the operative position, leg portion 210 of interlocking member 204 is in the vertical upward travel path of the contact block 192 on the work contact responsive member 190 thus preventing work contact responsive member from being moved into the operative position. It will be understood that movement of the trigger member 196 is rendered ineffective to actuate the piston 20 and fastener driving element 38 due to the work contact responsive member being prevented from movement from the inoperative position into the operative position.

Referring now more particularly to FIGS. 1, 11, 12, 13 and 14 and in accordance with the principles of the present invention there is shown a resilient guard structure 16 disposed on the main drive portion 44 of the housing 12 and extending outwardly from the periphery thereof at least on opposite sides thereof. Mechanical structure is provided for detachably securing the resilient guard structure 16 to the housing 12, generally indicated at 230. As shown, resilient guard structure 16 includes a U-shaped member 232 which extends around the front and both sides of the housing 12 in groove 240 although it will be understood that separate members could be provided and; secured only to the opposite sides of the main drive portion 44 which would provide support when the device 10 was placed down on an inclined roof surface when not in use. The mechanical structure 230 includes inwardly extending J-shaped hooks 234 fixedly embedded in the U-shaped member 232 on opposite sides thereof and to be brought into U-shaped receiving groove 242 in the housing 12 through which bolts 244 or the like which detachably fixedly mount a cap 246 on an open upper end of a drive portion 44 of the housing 12.

U-shaped member 232 may be made of any elastomeric material although 80 durometer urethane is preferred. In order to securably attach the resilient guard structure 16 to the housing 12 it is necessary to stretch the U-shaped member 16 from a relaxed condition to a stretched condition so as to place each of the J-shaped hooks 234 into a corresponding U-shaped receiving groove 242 formed in the housing 12. It will be understood that the U-shaped member 232 serves as its own resilient bias for securing resilient guard structure 16 to the housing 12. Further, means are provided by U-shaped member 232 for reducing lateral and vertical movement thereof relative to the housing including a pair of projecting portions 236 extending inwardly from the U-shaped member 232 which are brought into cooperating engagement with a pair of grooves which extend inwardly from the periphery of the housing (not shown).

It should be understood that the device 10 when not being used in portable fashion is capable of being selectively supported in either of two support positions on a support surface in which one side of the periphery of the housing main drive portion 44 faces toward the support surface with an area of corresponding outwardly facing surface of the resilient guard structure in engagement with the support surface. The area of engagement of the outwardly facing surface engaging the support surface and the coefficient of friction of the resilient material of the engaged outwardly facing surface area being such that the device will be stably supported in either support position on an inclined support surface, such as a roof surface, having an incline of 45° or less. Further, when the U-shaped member 232 has worn to such an extent that it should be replaced so as to provide the features described heretofore, the resilient guard structure 16 can be removed and a new one attached.

Referring now more particularly to FIGS. 1, 4, 14–16 and in accordance with the principles of the present invention there is shown therein a last nail holding means, generally indicated at 60, including magnetic means, generally indicated at 250, in the form of a magnet, means for dissipating air under pressure, in the form of a fastener driving element 38 and a fastener driving element guide 258, and exhaust means, generally indicated at 252, in the form of an exhaust passageway 254. As shown in FIG. 1, magnetic means 250 includes a cylindrical magnet 256 having a face cooperable with the drive track 26 and mounted with respect thereto in any suitable manner so as to attract the head of the last nail moved into the drive track. The exhaust means 252 includes a passageway 254 which is formed between the drive track 26 and the atmosphere and extends therebetween. Passageway 254 is formed in fastener driving element guide 258 and through the nosepiece 22.

Nail feeding means 58 in the form of a ratchet type fastener feeding mechanism is provided to feed the leading nails and the last nail of the array into the drive track 26. The feeding mechanism 58 is operatively located within the feed track 28 between the coil container 30 and the drive track 26. The feeding mechanism 58 is best understood first by reference to the feed track 28. As shown best in FIG. 2, one half of feed track 28 is formed by a feed track portion 280 of the housing 12 which extends rearwardly from the drive track 26 to the coil container 30 and is formed with a vertically extending surface 282 intersecting with the surface defining the drive track. The feed track portion 280 is formed with a groove 284 which defines an upwardly facing inclined surface which is adapted to engage beneath the heads of the nails to support the same so that their shanks extend along vertical surface 282. A forward portion of the feed track portion is formed with lateral openings which define a solid elongated element 286 therebetween which receives a nail feeding member, which will become apparent below. It will be understood that the coil container 30 contains a selected nail coil that is manually engaged in operative relation with the feeding mechanism 58 by engaging the heads of the nails within the groove 284 and the shanks in engagement with surface 282. As previously described, drive track door portion 64 contains a portion which forms the other half of the feed track when the unitary movable structure 32 is moved into the closed operative position.

As best shown in FIGS. 15 and 16, the nosepiece 22 has a cylinder 300 formed on the side opposite unitary movable structure 32 in laterally offset relation with respect to vertical surface 282. The cylinder includes a forward wall 302 apertured and sealed to sealingly receive therethrough an actuating rod 304.

It will be noted that the interior of the cylinder 300 adjacent the forward wall 302 is communicated with a conventional plenum return assembly 42 of the fastener driving device 10, as by passageway 306 (see FIG. 14), so as to move a piston 308 fixed to the rearward end of the actuating rod 304 and slidably mounted within the cylinder 300 into a retracted position, such as shown in FIG. 16. The piston 308 and actuating rod 304 are moved forwardly from the retracted position, as shown in FIG. 16, into an extended position, as shown in FIG. 15, by a pair of coil springs 310 and 312. Coil spring 310 has one end engaged with piston 308 and the other end within a cap 314 mounted in the open rear end of the cylinder 300. Spring 312 has one end engaged with a forward portion of the piston and the other end engaged with the cap 314 and guided by spring guide 316.

The actuating rod 304 extends forwardly and downwardly through the forward wall 302 of the cylinder 300 and has an aperture 318 formed in the forward portion thereof. A nail feeding member, generally indicated at 320, is pivotally connected to actuating rod 304 by pivot pin 322 inserted into aperture 318 which serves to pivotally mount the nail feeding member on the actuating rod for movement therewith along and about its axis and for relative pivotal movement with respect to the actuating rod between a nail engaging position, as shown in FIGS. 15 and 16 and a nail clearing position. A compression spring 324 mounted between actuating rod 304 and nail feeding member 320 serves to resiliently bias the nail feeding member 320 into its nail engaging position and to resiliently resist movement out of such position into the nail clearing position thereof.

The lateral surface of the nail feeding member 320 is suitably recessed to receive the elongated element 286 of the nosepiece 22. Formed on the lateral surface of the nail feeding member 320 is a leading series of vertically spaced teeth 330, 332 and 334. A second series of vertically spaced teeth 336, 338 and 340 are formed in rearwardly spaced relation from the leading series of teeth. A third series of vertically spaced teeth 342, 344 and 346 are formed on the rearward lateral surface of the nail feeding member 320 in rearwardly spaced relation to the second series of teeth. The teeth of the leading series are formed with vertically aligned forwardly facing surfaces 348 which, when the nail feeding member 320 is in its nail engaging position and the actuating rod is its extended position, serves to close off a substantial portion of the area of communication between the drive track 26 and the feed track 28. The leading teeth also include rearwardly inclined cam surfaces 350. Similarly, the second and third series of teeth include forwardly facing nail feeding surfaces 352 and 354, respectively, and rearward cam surfaces 356 and 358, respectively, and engaging the nail shanks and feeding same.

Drive track door portion 64 of unitary movable structure 32 is formed with a central recess 370 opening into the feed track 28 within which is mounted a nail holding member or pawl 372. As shown, a pin 374 serves to mount the nail holding member for pivotal movement between a nail engaging position as shown in FIGS. 15 and 16, and a nail clearing position. The nail holding member 372 is resiliently biased into its nail engaging position by a coil spring 376 which extends between drive track door portion 64 and nail holding member 372 and serves to resiliently resist pivotal movement of the member 372 in a direction toward the nail clearing position thereof. Formed on the lateral forward surface of nail holding member is a first series of vertically spaced teeth 378 and 380. A second and third series of vertically spaced teeth, 382, 384 and 386, 388, respectively, are formed in rearwardly spaced relation from the first series. Each series of teeth include a forwardly facing nail holding surface 390, 392 and 394 respectively, and a rearwardly inclined cam surface 396, 398 and 400, respectively. FIG. 2 illustrates that the array of nails is supported in the feed track 28 by engagement of the lower surfaces of the heads with the upwardly facing surfaces of the grooves 284.

Means for dissipating air provides a path for exhaust air within the plenum chamber assembly 42 to flow to the atmosphere through exhaust passageway 254. Referring now more particularly to FIG. 1, it will be noted that the plenum chamber assembly 42 is of generally conventional design and includes a return air plenum chamber 418 defined by the interior periphery of the main drive portion 44 of the main casting below the flange 420 and the adjacent exterior periphery of the cylinder 18. The plenum chamber 418 communicates with the lower end of the cylinder 18 as by a plurality of circumferentially spaced openings 414 and 422 formed in the cylinder 18 at a position adjacent the lower end thereof. Disposed within the lower end of the cylinder is an annular resilient bumper member 412 having its lower end seated in a mating surface at the bottom of cylinder 18. Centrally mounted below the cylinder 18 is the fastener driving element guide 258 which is apertured to receive the fastener driving element 38 therethrough. The aperture 424, as best shown in FIG. 15, provides a discharge passage for the return or exhaust air which exits from the cylinder 18. Fastener driving element 38 includes curved surfaces which form a close fitting relationship with step 426 so as to restrict the discharge of return air therebetween during the fastener driving element return stroke when the air pressure within return air plenum chamber 418 has reached its maximum. The clearance between fastener driving element 38 and the driver guide 258 is greatly increased at the end of the return stroke where the driving element is positioned above the step 426 so as to no longer be in close fitting relation therewith as shown best in FIG. 17. All remaining plenum air pressure can now rapidly escape through passages 254 and 428. It should be noted that the fastener driving element guide 258 is in closer fitting relation with the fastener driving element 38 during the drive and return stroke than at the end of the return stroke. The upper end of the bumper element is at approximately the same level as the openings 422 and is adapted to be engaged with the lower surface of the driving piston 20 when the latter reaches the end of its drive stroke.

The plenum chamber 42 is charged with air under pressure from the cylinder 18 when the driving piston 20 passes the holes 414 to the end of its drive stroke where it contacts the bumper element 412. To accomplish this function, a plurality of circumferentially spaced openings 414 are formed in the cylinder 18 at a position approximately two-thirds the vertical distance of the drive stroke. Additionally, an elastomeric annular check valve member 416 is located radially outwardly from the openings 414 so as to allow pressurized air within the cylinder 18 to flow into plenum chamber 42 when the pressure within the cylinder communicating therewith reaches a predetermined value.

The trigger valve assembly 52 may assume any desired configuration. However, a preferred construction is in accordance with the teachings contained in commonly assigned U.S. Pat. No. 5,083,694, the disclosure of which is hereby incorporated by reference into the present specification. The trigger valve assembly is resiliently biased into a normal inoperative position wherein a supply of air under pressure within hollow handle portion 14 of the housing 12 is enabled to pass through the trigger valve assembly 52 and into a passageway (not shown) which communicates with the pilot pressure chamber for main valve assembly 50. When the pilot pressure chamber is under pressure, the main valve assembly 50 is spring biased into a closed position as shown in FIG. 1. The main valve assembly 50 is pressure biased to move into an open position when the pressure in the pilot pressure chamber is relieved. The pilot pressure chamber is relieved when the actuating member 188 moves from an inoperative position to an operative position as described above.

OPERATION

Before commencing operation, it is first necessary to load a fastener package into an operative position within the coil container 30. To accomplish this, it is necessary initially to gain access to the coil container 30, feed track 28, drive track 26 as well as the ratchet type fastener feeding mechanism 58. The operator gains such access simply by gripping locking member 162 and moving it generally downwardly from an operative condition in which the unitary movable structure 32 is in a closed operative position into a releasing position. This downward movement releases the unitary movable structure 32 and the unitary movable structure will then be moved by gravity into the open loading position. In response to the unitary movable structure 32 being moved from the closed operating position to the open loading position, interlocking member 204 will move from its inoperative position to the operative position thereby blocking the movement of contact trip element 190. It will be further understood that in the event that the contact trip element 190 is prevented from movement from the inoperative position into the operative position, movement of the trigger member 196 will be rendered ineffective to actuate the driving piston 20 and fastener driving element 38.

To load a fastener package, after the last nail has been driven from the device, the operator adjusts the support assembly of the coil container to accommodate the particular length of fastener contained within a coiled nail package which is to be loaded therein. Since the operator has complete access to the support assembly 130 it is a simple matter for the operator to drop the fastener package over the spindle 134 and to manually position the leading portion of the outer coil layer of the fastener package so that the heads of the nails therein are engaged within the groove 284 and the three leading nails are disposed within the ratchet type fastener feeding mechanism 58. After the fastener package has been suitably loaded into the device, the unitary movable structure 32 is moved into the closed operating position.

To commence the operation of the device 10 it is then necessary to connect the inlet fitting of the reservoir to the outlet fitting of a hose leading from a source of air under pressure. Prior to making this connection, the entire air system within the device is at atmospheric pressure. When the source of air under pressure is connected with the reservoir 40, the pressure within the reservoir increases and this increase in pressure is immediately communicated with the pilot pressure chamber so as to maintain the spring biased pilot operated main valve assembly 50 in its closed position.

The device 10 is now in condition to be actuated by the actuating member 188 which is moved into its operative position when contact trip element 190 is in its operative position when brought into engagement with a workpiece and the trigger member 196 is moved into its operative position in response to digital pressure being exerted thereon by the operator. As soon as the trigger member 196 is moved into its operative position, air within the pilot pressure chamber is allowed to be exhausted.

As the air within the pilot pressure chamber is exhausted to atmosphere, the air under pressure within the reservoir 40 acting upwardly on the pilot operated main valve assembly 50 effects upward movement of the main valve assembly so as to communicate air under pressure within the reservoir 40 past the open main valve assembly 50 to the upper end of cylinder 18 which acts upon the upper surface of the driving piston 20 to effect a downward movement of the latter rapidly, from a first position, through its drive stroke. During the drive stroke, the fastener driving element 38 functions to drive a fastener within the drive track 26 outwardly thereof into a workpiece.

As the driving piston 20 approaches the end of its drive stroke, and a second position, the seal of the piston will pass the openings 414. The air under pressure acting on the upper surface of the piston passes through the openings 422, into the plenum chamber 418 and then the piston will engage the bumper element 412 as the drive stroke is completed. The trigger member 196 is then moved into its inoperative position either by the operator releasing the digital pressure on the trigger member 196 or by disengagement of the contact trip element 190 from the workpiece. In this manner, air under pressure from the reservoir 40 is communicated to the pilot pressure chamber which together with the spring returns the main valve assembly 50 to its closed position. This effects a communication path between the upper end of the cylinder 18 with the atmosphere through main valve assembly 50. As air within the cylinder 18 is exhausted, the high pressure air within the plenum chamber 418 acting on the lower surface of the piston 20 through openings 422 effects a relatively rapid return stroke of the piston. In this regard, it will be noted that the engagement of the piston 20 with the upper surface of the bumper element 412 serves to trap air so as to effect the aforesaid return stroke. The fastener drive element 38 is mounted with sufficient clearance with respect to fastener driving element guide 258 so that at the end of the return stroke the air under pressure effecting the return stroke of the piston dissipates to atmosphere so that when the piston reaches the upper end of its return stroke the air pressure in both the cylinder 18 as well as the plenum chamber 418 will be reduced to atmospheric pressure.

The operating cycle of the feeding mechanism 58 is illustrated in FIGS. 15 and 16. FIG. 15 illustrates the position of the parts after a feed stroke has been accomplished and it will be noted that such a feed stroke will completed during the return stroke of the fastener driving element 38. As soon as the force exerted by the air pressure in cylinder 300 on piston 308 drops below the forces exerted by springs 312 and 314, the springs 312 and 314 are operable to move the actuating rod 304 from its retracted position, shown in FIG. 16 to its extended position, as shown in FIG. 15. It will be noted that the forwardly facing surfaces 348 of the leading teeth 330, 332 and 334 are disposed in a position to close a substantial portion of the area of communication between the drive track 26 and the feed track 28. Springs 312 and 314 serve to maintain the actuating rod 304 and nail feeding member 320 in their extended positions so that any attempt of the nail being driven to enter into the feed track 28 is resisted by the forwardly facing surface 348. The springs 312 and 314, however, does allow the surface 348 to move rearwardly in the rare event of extreme forces, such as might be associated with an inadvertent jam, thereby protecting the feed mechanism components from accelerated wear or damage.

At the end of the drive stroke of the fastener driving element 38, the cylinder 300 is pressurized to move the piston 308 and actuating rod 304 into its retracted position against the bias of springs 312 and 314. As this return stroke of the actuating rod 304 takes place, the nail feed member 320 is moved therewith likewise through a return stroke. The cam surfaces 350 of the leading teeth are in substantial engagement with the leading nail in the feed track 28 and during the return stroke the cam surfaces 350 serve to move the nails in the feed track 28 rearwardly until the leading nail in the feed track moves into engagement with the holding surface 390 of the nail holding member 372. When this engagement takes place, the leading nail cannot move any further rearwardly and thus the further rearward movement of the nail feeding member 320 results in the cam surfaces 350 engaging the nail and effecting a pivotal movement of the nail holding member 320 against the bias of spring 324 into its nail clearing position.

When the nail feeding member 320 reaches either partly or entirely into its nail engaging position, the next three nails in the feed track 28 are immediately rearwardly of the cam surfaces 350, 356 and 358. As further movement takes place during the return stroke, the nail feeding member 320 is cammed into its nail clearing position by the action of cam surfaces 350, 356 and 358 engaging their respective nails which are held against rearward movement by the wires connecting the same to the leading nail and next two nails which are held against rearward movement by the wires connecting the same to the adjacent nail which is held by the nail holding member 372. The extent of the return stroke is such that the nail feeding surfaces 352 and 354 move past the second and third nails, respectively, and slightly rearwardly thereof as shown in FIG. 16. During this movement, the engagement of the nail feeding surfaces 348, 352 and 354 with the second, third and fourth nails in the feed track 28 serves to move these nails forwardly and by virtue of the connecting wires, the leading nail likewise forwardly. The effect of this engagement is to pivot the nail holding member 372 out of its nail engaging position against the bias of the spring 376 after which the spring 376 serves to return the nail holding member 372 back into its nail engaging position. Thereafter, the completion of the feed stroke of the actuating rod 304 serves to move the leading nail into the drive track 26 as shown in FIG. 15, thus completing the cycle.

It should be noted that the last nail will be fed into the drive track by nail feeding member 320, not by virtue of the connecting wires, but rather by the forward movement of forwardly facing surface 348 into the nail clearing position. Nail feeding member 320 moves forwardly with sufficient force so as to thrust the last nail into the drive track 26 from the feed track 28 where the last nail will be supported by magnet 256. As described heretofore, the feed stroke of nail feeding member 320 is completed during the return stroke of the fastener driving element 38 so that the last nail is being supported by the magnet 256 at the end of the return stroke of the fastener feeding element 38. At the end of the return stroke of the fastener feeding element, residual air in the plenum chamber and the air below the piston exhausts between the fastener driving element 38 and the fastener driving guide 258. To prevent the exhaust air from blowing the last nail held by the magnet 256 off of the magnet and out of the drive track 26, an exhaust passageway 254 permits the exhaust air to exit through this passageway without impinging on the last nail. Furthermore, the fastener driving element is in close fitting mating relationship with driving guide 258, providing reduced clearance so as to restrict exhaust airflow down through the drive track 26 during the drive and return stroke when the pressure is at its highest. However, the holding power of the magnet 256 and the force exerted by the exhaust air on the last nail is such that the last nail will be held in the drive track 26 until driven therefrom during the drive stroke of the fastener driving element 38.

Also, as described heretofore, if the device is not in use and is placed down on a pitched roof surface, the resilient guard structure 16 will stably support the device 10 and prevent it from sliding on the pitched roof surface having an inclined surface of less than 45°.

It will thus be seen that the objects of this invention have been fully and effectively accomplished. We realize, however, that the foregoing preferred specific embodiments have been shown and described for the purpose of illustrating the functional instructional principles of this invention subject to change without departure from such principles. Therefore, this invention includes all modifications encompassed within the spirit and scope of the following claims.

What is claimed is:

1. A fastener driving device for driving successive fasteners from a fastener package of the type including an array of interconnected fasteners wound in a coil formation, said device comprising:

a housing including a handle portion enabling a user to manually operate said device in portable fashion and a drive portion disposed forwardly of said handle portion;

power operated drive means in said housing drive portion operable to be selectively moved through successive operating cycles each of which includes a drive stroke and a return stroke;

a nosepiece and magazine assembly carried by said housing including a movable structure defining an elongated drive track in cooperation with said housing, a feed track leading into said drive track, and a coil container leading into said feed track;

a fastener driving element slidably mounted in said drive track and operatively connected with said drive means so as to drive a leading fastener fed into said drive track from said feed track outwardly of said drive track and into a workpiece during the drive stroke of said drive means;

said nosepiece and magazine assembly movable structure including a unitary movable structure defining a side portion of said drive track, a side portion of said feed track and a side and top portion of said coil container;

said unitary movable structure being mounted for pivotal movement when a fastener package has been depleted from a closed operative position in cooperating relation with said housing into an open loading position wherein (1) said drive track is accessible along the side portion defined by said unitary movable structure so as to enable a leading fastener of a new fastener package to be positioned therein, (2) said feed track is accessible along the side portion defined by said unitary movable structure so as to enable a leading portion of the array of the new fastener package to be positioned therein, and (3) said coil container is accessible along the side and top portions defined by said unitary movable structure so as to enable the coil formation of the new fastener package to be positioned therein, and from said open loading position after a new package has been positioned as aforesaid into said closed operative position; and a releasable latch mounted for manual movement from an operative position retaining said unitary movable structure in said closed operative position into a releasing position, the position of the pivotal axis of said unitary movable structure being such that when said device is held by said handle portion in a position such that a fastener would be moved out of said drive track in a substantial downward direction said unitary movable structure will be moved by gravity from said closed operative position into said open loading position in response to the manual movement of said latch into said releasing position, wherein said unitary movable structure has a longitudinal axis extending generally in the direction of extent of said feed track and said unitary movable structure is pivotably connected to said housing so as to pivot about said longitudinal axis.

2. A fastener driving device as defined in claim 1 further comprising an actuating mechanism including a work contact responsive member movable between and inoperative position and an operative position permitting the actuation of said power operated drive means to move through an operating cycle, and an actuating prevention mechanism constructed and arranged with respect to said unitary movable structure and cooperable with said work contact responsive member to prevent the actuation of said power operated drive means by preventing the work contact responsive member from moving to the operative position thereof when said unitary movable structure is moved from said closed operating position to said open loading position.

3. A fastener driving device as defined in claim 2 further comprising resilient guard structure on opposite sides of the periphery of a main drive portion of said housing and extending outwardly therefrom, said resilient guard structure having outwardly facing surfaces disposed outwardly of the opposite sides of the periphery of said housing main drive portion, said device being capable of being selectively supported on a support surface when an area of an outwardly facing surface of the resilient guard structure is in engagement with the support surface, and mechanical structure for fixedly mounting said resilient guard structure to said housing drive portion, said mechanical structure including J-shaped hooks embedded in opposite ends of said resilient guard structure and extending outwardly thereof and bolts entering said J-shaped hooks, said bolts also serving to detachably fixedly mount a cap on an open upper end of a drive portion of said housing disposed forwardly of the handle portion thereof.

4. A fastener driving device as defined in claim 3 wherein said power operated drive means is pneumatic, said pneumatic drive means includes a cylindrical drive chamber and a piston mounted within said drive chamber and operatively connected with said fastener driving element for movement through a drive stroke and a return stroke.

5. A fastener driving device as defined in claim 4 further comprising means within said housing defining a return air plenum chamber for effecting said fastener driving element return stroke, nail feeding means mounted for movement only within said feed track so as to successively move the leading nails of the array into said drive track and to thrust the last nail of the array into said drive track at the end of said return stroke such that the last nail moves into the drive track under its own momentum, said cylindrical drive chamber having one end arranged for communication with said plenum chamber so that air under pressure in said plenum chamber can effect the return stroke of said piston, last nail holding means for retaining the last nail of the array within said drive track such that the last nail of the array is driven outwardly of said drive track and into a workpiece during the drive stroke of said fastener driving element, said last nail holding means including a magnet mounted to said nosepiece and extending to the periphery of said drive track for receiving and holding the head of the last nail when thrust into said drive track by said nail feeding means and means for dissipating the air under pressure within said plenum chamber so that air under pressure within said plenum chamber which effects the return stroke of said piston is exhausted through said drive track to the atmosphere at the end of the return stroke of said piston so that the last nail being held by said magnet is not blown off of said magnet by air exhausting said plenum chamber.

6. A fastener driving device as defined in claim 1 further comprising an actuating mechanism including a work contact responsive member movable between and inoperative position and an operative position for preventing the actuation of said power operated drive means to move through an operating cycle, and an actuating prevention mechanism cooperable with said work contact responsive member for preventing the actuation of said power operated drive means by preventing the work contact responsive member from moving to the operative position thereof when said unitary movable structure is moved from said closed operating position to said open loading position.

7. A fastener driving device as defined in claim 6 further comprising resilient guard structure on opposite sides of the periphery of a main drive portion of said housing and extending outwardly therefrom, said resilient guard structure having outwardly facing surfaces disposed outwardly of the opposite sides of the periphery of said housing main drive portion, said device being capable of being supported on a support surface when an area of an outwardly facing surface of the resilient guard structure is in engagement with the support surface, and mechanical structure for fixedly mounting said resilient guard structure to said housing main drive portion, said mechanical mounting structure including J-shaped hooks embedded in opposite ends of said resilient guard structure and extending outwardly thereof and bolts entering said J-shaped hooks, said bolts also serving to detachably fixedly mount a cap on an open upper end of a drive portion of said housing disposed forwardly of the handle portion thereof.

8. A fastener driving device as defined in claim 1 further comprising resilient guard structure on opposite sides of the periphery of a main drive portion of said housing and extending outwardly therefrom, said resilient guard structure having outwardly facing surfaces disposed outwardly of the opposite sides of the periphery of said housing main drive portion, said device being capable of being supported on a support surface when an area of a corresponding outwardly facing surface of the resilient guard structure is in engagement with the support surface, and mechanical structure for fixedly mounting said resilient guard structure to said housing main drive portion, said mechanical mounting structure including J-shaped hooks embedded in opposite ends of said resilient guard structure and extending outwardly thereof and bolts entering said J-shaped hooks, said bolts also serving to detachably fixedly mount a cap on an open upper end of a drive portion of said housing disposed forwardly of the handle portion thereof.

9. A fastener driving device as defined in claim 1 wherein said power operated drive means is pneumatic, said pneumatic drive means includes a cylindrical drive chamber and a piston mounted within said drive chamber and operatively connected with said fastener driving element for movement through a drive stroke and a return stroke.

10. A fastener driving device as defined in claim 9 further comprising means within said housing defining a return air plenum chamber for effecting said fastener driving element return stroke, nail feeding means mounted for movement only within said feed track so as to successively move the leading nails of the array into said drive track and to thrust the last nail of the Array into said drive track at the end of said return stroke such that the last nail moves into the drive track under its own momentum, said cylindrical drive chamber having one end arranged for communication with said plenum chamber so that air under pressure in said plenum chamber can effect the return stroke of said piston, last nail holding means for retaining the last nail of the array within said drive track such that the last nail of the array is driven outwardly of said drive track and into a workpiece during the drive stroke of said fastener driving element, said last nail holding means including a magnet mounted to said nosepiece and extending to the periphery of said drive track for receiving and holding the head of the last nail when thrust into said drive track by said nail feeding means and means for dissipating the air under pressure within said plenum chamber so that air under pressure within said plenum chamber which effects the return stroke of said piston is exhausted through said drive track to the atmosphere at the end of the return stroke of said piston so that the last nail being held by said magnet is not blown off of said magnet by air exhausting said plenum chamber.

11. A fastener driving device for driving successive fasteners from a fastener package of the type including an array of interconnected fasteners wound in a coil formation, said device comprising:

a housing including a handle portion enabling a user to manually operate said device in portable fashion and a drive portion disposed forwardly of said handle portion;

power operated means in said housing drive portion operable to be selectively moved through successive operating cycles each of which includes a drive stroke and a return stroke;

a nosepiece and magazine assembly carried by said housing including a movable structure defining an elongated drive track in cooperation with said housing, a feed track leading into said drive track, and a coil container leading into said feed track;

a fastener driving element slidably mounted in said drive track and operatively connected with said drive means so as to drive a leading fastener fed into said drive track from said feed track outwardly of said drive track and into a workpiece during the drive stroke of said drive means;

said nosepiece and magazine assembly movable structure including a unitary movable structure defining a side portion of said drive track, a side portion of said feed track and a side and top portion of said coil container;

said unitary movable structure having a longitudinal axis extending generally in the direction of extent of said feed track, said unitary movable structure being pivotably connected to said housing along said longitudinal axis and being movable when a fastener package has been depleted from a closed operating position in cooperating relation with said housing into an open loading position wherein (1) said drive track is accessible along the side portion defined by said unitary movable structure so as to enable a leading fastener of a new fastener package to be positioned therein, (2) said feed track is accessible along the side portion defined by said unitary movable structure so as to enable a leading portion of the array of the new fastener package to be positioned therein, and (3) said container is accessible along the side and top portions defined by said unitary movable structure so as to enable the coil formation of the new fastener package to be positioned therein, and from said open loading position after a new package has been positioned as aforesaid into said closed operative position; and a releasable latch mounted for manual movement from an operative position retaining said unitary movable structure in said closed operative position into a releasing position, wherein the position of said longitudinal axis of said unitary movable structure being such that when said device is held by said handle portion in a position such that a fastener would be moved out of said drive track in a substantial downward direction, said unitary movable structure will be moved by gravity from said closed operative position into said open loading position in response to the manual movement of said latch into said releasing position.

12. A fastener driving device as defined in claim 11, wherein the center of gravity of said unitary movable structure in said closed operative position is laterally spaced from said longitudinal axis.

13. A fastener driving device as defined in claim 12, wherein the center of gravity of said unitary movable structure in said open loading position is disposed below said device.

14. A fastener driving device as defined in claim 13, wherein said longitudinal axis of said unitary movable structure is inclined relative to a horizontal plane when said handle portion extends horizontally.

15. A fastener driving device as defined in claim 13, wherein said unitary movable structure includes a coil container portion forming said side and top portions of said coil container and a drive track door portion forming said side portion of said drive track and said side portion of said feed track.

16. A fastener driving device as defined in claim 15, wherein said drive track door portion and said coil container portion each include hinge means which serve to effect the pivotal connection of said unitary movable structure to said fixed structure.

17. A fastener driving device as defined in claim 15, wherein said releasable latch is mounted on an outer portion of said drive track door portion and is engageable with a catch portion fixed to said fixed structure for releasably locking said unitary movable structure in said closed operative position.

18. A fastener driving device as defined in claim 17, wherein said releasable latch is biased into said latching position by spring means operatively connected between said releasable latch and said drive track door portion, said releasable latch includes a locking portion carried by said drive track door portion for normally biased movement into a latching position within an opening in said catch portion and a manually engageable portion for enabling the locking portion to be manually moved out of such latching position into a release position, said catch portion having a cam surface engageable with said locking portion to retract said locking portion into a position to enter said opening when said unitary movable structure is moved from said open loading position into said closed operative position.

19. A fastener driving device as defined in claim 11, wherein said coil container includes a circular fastener support member adapted to receive in supporting relation the coil formation of the fastener package disposed within said coil container, and means to adjust the position of said fastener support member along an axis perpendicular to the longitudinal extent of said feed track to accommodate fastener packages of different fastener length size.

20. A fastener driving device for driving successive fasteners from a fastener package of the type including an array of interconnected fasteners wound in a coil formation comprising:

a housing including a handle portion enabling a user to manually operate said device in portable fashion and a drive portion disposed forwardly of said handle portion;

power operated drive means in said housing drive portion actuatable to be moved through successive operating cycles each of which includes a drive stroke and a return stroke;

a nosepiece and magazine assembly carried by said housing including a movable structure defining an elongated drive track in cooperation with said housing, a feed track leading into said drive track, and a coil container leading into said feed track;

a fastener driving element slidably mounted in said drive track and operatively connected with said drive means so as to drive a leading fastener fed into said drive track from said feed track outwardly of said drive track and into a workpiece during the drive stroke of said drive means;

said nosepiece and magazine assembly movable structure defining a side portion of said drive track, a side portion of said feed track and a side and top portion of said container;

said movable structure being mounted for movement when a fastener package has been depleted from a closed operating position in cooperating relation with said housing into an open loading position wherein (1) said drive track is accessible along the side portion defined by said movable structure so as to enable a leading fastener of a new fastener package to be positioned therein, (2) said feed track is accessible along the side portion defined by said movable structure so as to enable a leading portion of the array of the new fastener package to be positioned therein, and (3) said coil container is accessible along the side and top portions defined by said movable structure so as to enable the coil formation of the new fastener package to be positioned therein, and from said open loading position after a new package has been positioned as aforesaid into said closed operating position;

an actuating mechanism for actuating said power operated drive means to move through an operating cycle; and an actuating prevention mechanism for preventing the actuation of said power operated means by said actuating mechanism in response to the movement of said movable structure from said closed operating position to said open loading position;

wherein said actuating mechanism includes a contact trip element mounted for movement adjacent said nosepiece for movement from an inoperative position to an operative position when said nosepiece is normally moved into engagement with a workpiece and a trigger member mounted on said housing adjacent said handle portion for movement from an inoperative position into an operative position, and wherein said actuating mechanism includes an actuating member carried by said housing for movement from a normal inoperative position into an operative position for selectively actuating said power operated means to move through an operating cycle in response to the movement of said contact trip element and said trigger member into their respective operative positions, and wherein said actuating mechanism further includes a linkage operatively associated with said contact trip element, said trigger member and said actuating member for (1) enabling movement of said trigger member into its operative position when said contact trip element is in its inoperative position without movement of said actuating member into its operative position, (2) enabling movement of said trigger member into its operative position when said contact trip element is in its operative position to effect movement of said actuating member into its operative position, and (3) enabling movement of said contact trip element when said trigger member is in its inoperative position without movement of said actuating member into its operative position, said actuating prevention mechanism including an interlocking member mounted for movement in response to the movement of said movable structure between the closed operating and open loading position thereof between (a) a normal inoperative position enabling said contact trip element to undertake the aforesaid movements (2) and (3) when said movable structure is in said closed operating position, and (b) an operative position preventing said contact trip element from being moved into said operative position from said inoperative position when said movable structure is in said open loading position.

21. A fastener driving device as defined in claim 20, wherein said actuating mechanism includes a contact trip element mounted for movement adjacent said nosepiece for movement from an inoperative position to an operative position when said nosepiece is normally moved into engagement with a workpiece and a trigger member mounted on said housing adjacent said handle portion for movement from an inoperative position into an operative position.

22. A fastener driving device as defined in claim 21, wherein said actuating mechanism includes an actuating member carried by said housing for movement from a normal inoperative position into an operative position for selectively actuating said power operated means to move through an operating cycle in response to the movement of said contact trip element and said trigger member into their respective operative positions.

23. A fastener driving device as defined in claim 20 wherein said power operated drive means is pneumatic, said pneumatic drive means includes a cylindrical drive chamber and a piston mounted within said drive chamber and operatively connected with said fastener driving element for movement through a drive stroke and a return stroke.

24. A fastener driving device as defined in claim 23 further comprising means within said housing defining a return air plenum chamber for effecting said fastener driving element return stroke, nail feeding means mounted for movement only within said feed track so as to successively move the leading nails of the array into said drive track and to thrust the last nail of the array into said drive track at the end of said return stroke such that the last nail moves into the drive track under its own momentum, said cylindrical drive chamber having one end arranged for communication with said plenum chamber so that air under pressure in said plenum chamber can effect the return stroke of said piston, last nail holding means for retaining the last nail of the array within said drive track such that the last nail of the array is driven outwardly of said drive track and into a workpiece during the drive stroke of said fastener driving element, said last nail holding means including a magnet mounted to said nosepiece and extending to the periphery of said drive track for receiving and holding the head of the last nail when thrust into said drive track by said nail feeding means and means for dissipating the air under pressure within said plenum chamber so that air under pressure within said plenum chamber which effects the return stroke of said piston is exhausted through said drive track to the atmosphere at the end of the return stroke of said piston so that the last nail being held by said magnet is not blown off of said magnet by air exhausting said plenum chamber.

25. A fastener driving device for driving successive fasteners from a fastener package of the type including an array of interconnected fasteners wound in a coil formation comprising:

a housing including a handle portion enabling a user to manually operate said device in portable fashion and a drive portion disposed forwardly of said handle portion;

power operated drive means in said housing drive portion actuatable to be moved through successive operating cycles each of which includes a drive stroke and a return stroke;

a nosepiece and magazine assembly carried by said housing including a movable structure defining an elongated drive track in cooperation with said housing, a feed track leading into said drive track, and a coil container leading into said feed track;

a fastener driving element slidably mounted in said drive track and operatively connected with said drive means so as to drive a leading fastener fed into said drive track from said feed track outwardly of said drive track and into a workpiece during the drive stroke of said drive means;

said nosepiece and magazine assembly movable structure defining a side portion of said drive track, a side portion of said feed track and a side and top portion of said container;

said movable structure being mounted for movement when a fastener package has been depleted from a closed operating position in cooperating relation with said housing into an open loading position wherein (1) said drive track is accessible along the side portion defined by said movable structure so as to enable a leading fastener of a new fastener package to be positioned therein, (2) said feed track is accessible along the side portion defined by said movable structure so as to enable a leading portion of the array of the new fastener package to be positioned therein, and (3) said coil container is accessible along the side and top portions defined by said movable structure so as to enable the coil formation of the new fastener package to be positioned therein, and from said open loading position after a new package has been positioned as aforesaid into said closed operating position;

an actuating mechanism for actuating said power operated drive means to move through an operating cycle;

an actuating prevention mechanism for preventing the actuation of said power operated means by said actuating mechanism in response to the movement of said movable structure from said closed operating position to said open loading position;

resilient guard structure on opposite sides of the periphery of a main drive portion of said housing and extending outwardly therefrom, said resilient guard structure having outwardly facing surfaces disposed outwardly of the opposite sides of the periphery of said housing main drive portion, said device being capable of being supported on a support surface when an area of a corresponding outwardly facing surface of the resilient guard structure is in engagement with the support surface, and mechanical structure for fixedly mounting said resilient guard structure to said housing main drive portion, said mechanical mounting structure including J-shaped hooks embedded in opposite ends of said resilient guard structure and extending outwardly thereof and bolts entering said J-shaped hooks, said bolts also serving to detachably fixedly mount a cap on an open upper end of a drive portion of said housing disposed forwardly of the handle portion thereof.

26. A fastener driving device for use in installing roofs comprising:

a housing including a handle portion enabling a user to manually operate said device in portable fashion, a main drive portion disposed forwardly of said handle portion and a nose portion defining a fastener drive track aligned with that of said drive portion;

a fastener driving element slidably mounted in said drive track;

a fastener magazine assembly for feeding successive fasteners laterally into said drive track;

power operated drive means actuatable to move said fastener driving element through successive operating cycles each of which includes a drive stroke during which a fastener fed to said drive stroke is driven outwardly thereof into a workpiece and a return stroke;

said housing main drive portion including a periphery having opposite sides;

resilient guard structure on opposite sides of the periphery of said housing main drive portion and extending outwardly therefrom, said resilient guard structure having outwardly facing surfaces disposed outwardly of the opposite sides of the periphery of said housing main drive portion;

said device being capable of being supported on a support surface when an area of a corresponding outwardly facing surface of the resilient guard structure is in engagement with the support surface; and mechanical structure for fixedly mounting said resilient guard structure;

said mechanical mounting structure includes J-shaped hooks embedded in opposite ends of said resilient guard structure and extending outwardly thereof and bolts entering said J-shaped hooks, said bolts also serving to detachably fixedly mount a cap on an open upper end of a drive portion of said housing disposed forwardly of the handle portion thereof.

27. A fastener driving device as defined in claim 26, wherein said outwardly facing surfaces of the resilient guard structure are made of elastomeric material.

28. A fastener driving device as defined in claim 17, wherein said resilient guard structure is U-shaped.

29. A fastener driving device as defined in claim 28, wherein said resilient guard structure has a relaxed condition and a stretched attached condition and said bolts entering said J-shaped hooks attached to the resilient guard structure requires that said resilient guard structure be stretched from said relaxed condition into said stretched attached condition so as to place each of said J-shaped hooks within a U-shaped receiving groove formed in the periphery of the drive portion of the housing.

30. A fastener driving device as defined in claim 29, wherein said resilient guard structure is disposed on opposite sides of said housing in a direction generally parallel to said feed track.

31. A fastener driving device as defined in claim 26, wherein said power operated drive means is pneumatic, said pneumatic drive means includes a cylindrical drive chamber and a piston mounted within said drive chamber and operatively connected with said fastener driving element for movement through a drive stroke and a return stroke.

32. A fastener driving device as defined in claim 31 further comprising means within said housing defining a return air plenum chamber for effecting said fastener driving element return stroke, nail feeding means mounted for movement only within said feed track so as to successively move the leading nails of the array into said drive track and to thrust the last nail of the array into said drive track at the end of said return stroke such that the last nail moves into the drive track under its own momentum, said cylindrical drive chamber having one end arranged for communication with said plenum chamber so that air under pressure in said plenum chamber can effect the return stroke of said piston, last nail holding means for retaining the last nail of the array within said drive track such that the last nail of the array is driven outwardly of said drive track and into a workpiece during the drive stroke of said fastener driving element, said last nail holding means including a magnet mounted to said nosepiece extending to the periphery of said drive track for receiving and holding the head of the last nail when thrust into said drive track by said nail feeding means and means for dissipating the air under pressure within said plenum chamber so that air under pressure within said plenum chamber which effects the return stroke of said piston is exhausted through said drive track to the atmosphere at the end of the return stroke of said piston so that the last nail being held by said magnet is not blown off of said magnet by air exhausting said plenum chamber.

33. A fastener driving device for driving successive fasteners from an array of interconnected fasteners comprising:

a housing including a handle portion enabling a user to manually operate said device in portable fashion;

a nosepiece having means defining an elongated drive track and a magazine assembly having means defining a nail feed track which communicates laterally with said drive track;

a fastener driving element slidably mounted within said drive track for movement through a drive stroke to drive a fastener in said drive track outwardly into a workpiece and through a return stroke;

means within said housing defining a return air plenum chamber for effecting said fastener driving element return stroke;

nail feeding means mounted for movement only within said feed track so as to successively move the leading nails of the array into said drive track and to thrust the last nail of the array into said drive track at the end of said return stroke;

pneumatic drive means operable to move said piston selectively through successive drive strokes;

a piston mounted within said drive chamber and operatively connected with said fastener driving element for movement through a drive stroke and a return stroke;

said pneumatic drive means including a cylindrical drive chamber having one end arranged for communication with said plenum chamber so that air under pressure in said plenum chamber can effect the return stroke of said piston;

last nail holding means for retaining the last nail of the array within said drive track such that the last nail of the array is driven outwardly of said drive track and into a workpiece during the drive stroke of said fastener driving element;

said last nail holding means including a magnet mounted to said nosepiece and extending to the periphery of said drive track for receiving and holding the head of the last nail when thrust into said drive track by said nail feeding means and means for dissipating the air under pressure within said plenum chamber so that air under pressure within said plenum chamber which effects the return stroke of said piston is exhausted through said drive track to the atmosphere at the end of the return stroke of said piston so that the last nail being held by said magnet is not blown off of said magnet by air exhausting said plenum chamber.

34. A fastener driving device as defined in claim 33, wherein said magnet is cylindrical, said magnet having opposite faces one of which is in communication with said drive track.

35. A fastener driving device as defined in claim 33, wherein said nail feeding means includes an actuating rod having a longitudinal axis extending in the direction of extent of said feed track for axial reciprocating movement from a retracted position in a direction toward said drive track through a feed stroke into an extended position and from said extended position in a direction away from said drive track through a return stroke into said retracted position, a nail feeding member mounted on said actuating rod for pivotal and axial reciprocating movements with said actuating rod and for pivotal movement relative to said actuating rod about an axis parallel with the extent of said drive track in opposite directions, first spring means for biasing said nail feeding member to pivotally move with respect to said actuating member in one direction into a nail engaging position and for resisting pivotal movement in the opposite direction into a nail clearing position, second spring means for effecting axial movement of said actuating rod through its feed stroke and for resiliently resisting axial movement in a direction away from said drive track, power operated means for effecting axial movement of said actuating rod through its return stroke and for enabling said second spring means to effect the feed stroke thereof and to resiliently resist axial movement thereof in the direction away from said drive track when said actuating rod is in said extended position, a nail holding member mounted for pivotal movement about an axis parallel with the extent of said drive track in opposite directions, and third spring means for biasing said nail holding member to pivotally move in one direction into a nail holding position and for resiliently resisting movement in the opposite direction into a nail clearing position, said drive track defining means including a discharge end, said feed track defining means including operatively fixed head controlling surfaces means facing inwardly with respect to said drive track in a direction away from the discharge end thereof for engaging the nail heads and supporting the nails in the feed track, said nail feeding member having a leading series of teeth aligned and spaced apart in the direction of extent of drive track, a second series of teeth aligned and spaced apart in the direction of extent of said drive track spaced apart from said leading series of teeth in the direction of extent of said feed track and a third series of teeth aligned and spaced apart from said second series of teeth in the direction of extent of said feed track, said second and third series of teeth each having feed surface means facing toward said drive track for engaging a nail shank in said feed track and successively moving the leading nails and last nail in said feed track into said drive track during the feed stroke of said actuating rod when said nail feeding member is in said nail engaging position, said nail holding member having cam surface means operable during the feed stroke of said actuating rod to be engaged by a moving nail shank to initially effect a pivotal movement of said nail holding member in said opposite direction against the resilient resistance of said third spring means into said nail clearing position and thereafter to allow a pivotal movement of said nail holding member in said one direction under the bias of said third spring means into said nail holding position, said nail holding member having nail holding surface means facing in a direction toward said drive track for engaging a nail shank when said nail holding member is in said nail holding position, said teeth having cam surface means operable during the return stroke of said actuating rod to initially effect pivotal movement of said nail feeding member by engagement with a nail shank in said opposite direction into said nail clearing position and to thereafter allow said first spring means to effect pivotal movement of said nail feeding member in said one direction into said nail engaging position.

36. A fastener driving device as defined in claim 35, wherein said nosepiece and magazine assembly include a movable structure defining said elongated drive track, said feed track in cooperation with said housing, and a coil container leading into said feed track.

37. A fastener driving device as defined in claim 36, wherein said nail holding member is pivoted on said movable structure and said third spring means is mounted between said movable member and said nail holding member.

38. A fastener driving device as defined in claim 33, wherein said means for dissipating air includes said fastener guide element and a fastener guide member disposed in said drive track, said fastener guide member having an aperture therethrough for slidably receiving said fastener driving element in close fitting relation thereto.

39. A fastener driving device as defined in claim 38, wherein said fastener guide member and said fastener are in closer fitting relation at the beginning of said return stroke than at the end of said return stroke.

40. A fastener driving device as defined in claim 39, wherein said means for dissipating air is disposed between said cylindrical chamber and the last nail moved into said drive track.

41. A fastener driving device as defined in claim 40, wherein said means for dissipating air further includes an opening formed in said housing and an opening formed in said fastener guide member in communication with said opening in said housing, said openings forming a passageway extending between said drive track and the atmosphere.

* * * * *